US012629581B2

(12) United States Patent
Lavers et al.

(10) Patent No.: US 12,629,581 B2
(45) Date of Patent: May 19, 2026

(54) PICKLEBALL SCORING SYSTEM

(71) Applicant: SRVRSKOR, LLC, Bristol, IN (US)

(72) Inventors: Richard M. Lavers, Bristol, IN (US); Deepinder Singh, Brampton (CA)

(73) Assignee: SRVRSKOR, LLC, Bristol, IN (US)

( * ) Notice: Subject to any disclaimer, the term of this patent is extended or adjusted under 35 U.S.C. 154(b) by 0 days.

(21) Appl. No.: 19/216,926

(22) Filed: May 23, 2025

(65) Prior Publication Data

US 2025/0360390 A1 Nov. 27, 2025

Related U.S. Application Data

(60) Provisional application No. 63/651,667, filed on May 24, 2024.

(51) Int. Cl.
*A63B 71/06* (2006.01)

(52) U.S. Cl.
CPC ..... *A63B 71/0669* (2013.01); *A63B 71/0616* (2013.01); *A63B 71/0622* (2013.01); *A63B 2071/0625* (2013.01); *A63B 2071/0694* (2013.01); *A63B 2225/50* (2013.01)

(58) Field of Classification Search
CPC ..... A63B 71/0669; A63B 71/0616; A63B 71/0622; A63B 2071/0625; A63B 2071/0694; A63B 2225/50
See application file for complete search history.

(56) References Cited

U.S. PATENT DOCUMENTS

| | | | | |
|---|---|---|---|---|
| 12,223,217 | B2 * | 2/2025 | Porter, Jr. | G06F 3/14 |
| 2010/0134383 | A1 * | 6/2010 | Mele | G09G 3/28 345/1.3 |
| 2012/0256373 | A1 * | 10/2012 | Tam | A63D 15/20 273/148 R |
| 2015/0217179 | A1 * | 8/2015 | Olsson | A63B 71/0616 700/91 |
| 2016/0008695 | A1 * | 1/2016 | Aman | A63B 71/0669 348/157 |

(Continued)

OTHER PUBLICATIONS

Dropshot, Web Page—Dropshot Pickleball Scoreboard Retrieved from the Internet: https://godropshot.com/products/dropshot-pickleball-scoreboard, 3 pages, Dec. 14, 2024.

*Primary Examiner* — Malina D. Blaise
(74) *Attorney, Agent, or Firm* — Woodard, Emhardt, Henry, Reeves & Wagner, LLP

(57) ABSTRACT

A scoring system for pickleball and other games. The scoring system generally includes a scoreboard configured to track and display the score and/or the serving player throughout a game. The scoreboard is configured to receive inputs to change the score, the serving player, and/or the serving team. In one example, the scoreboard includes a speaker configured to audibly announce the score of each team and the serving player before each serve. The scoring system includes remote controls, such as fobs, that allow players to control the scoreboard remotely. Further, the scoring system is expandable to include multiple displays and/or multiple scoreboards. The system includes a data management system that communicates with multiple scoreboards, such as for tracking performance and arranging matchups. The scoreboard is configured to connect to an external display, such as through a wireless connection.

12 Claims, 28 Drawing Sheets

(56) References Cited

U.S. PATENT DOCUMENTS

| | | | | |
|---|---|---|---|---|
| 2017/0340949 | A1* | 11/2017 | Tsai | A63B 67/04 |
| 2024/0205519 | A1* | 6/2024 | Van Bergen | H04N 21/2368 |
| 2024/0245976 | A1* | 7/2024 | Cohen | G06F 3/1454 |
| 2024/0342580 | A1* | 10/2024 | Brown | A63B 71/0605 |
| 2025/0213956 | A1* | 7/2025 | Melton | A63B 71/0622 |
| 2025/0269289 | A1* | 8/2025 | Charity | A63F 13/86 |

* cited by examiner

PICKLEBALL SCORING SYSTEM

BACKGROUND

Sports such as pickleball, tennis, table tennis, and/or other racket or paddle sports are commonly played both casually and competitively by players of varying experience. Oftentimes, players and/or spectators keep score of the game and track other details mentally. In some cases, players forget the score. For instance, players can get distracted by interruptions and/or be too focused on the game to consistently and accurately keep track of the score. Additionally, new players who are less familiar with the rules of the game sometimes keep score incorrectly and/or fail to follow other rules. Losing track of the score can hold up games, cause disputes over the score, and generally reduce the enjoyment of playing the game. Further, sports like pickleball are commonly played in the form of a tournament or other event. Forgetting the score or losing track of other details in a tournament game can delay players waiting to play another game, lead to disputes involving other players or teams, and/or disrupt the tournament in other ways.

Thus, there is a need for improvement in this field.

SUMMARY

Many individuals of various skill levels and experience enjoy playing pickleball and other paddle or racket sports. In casual play, players typically must keep score of the game themselves and oftentimes track the score mentally. Because players focus on the game and/or can become distracted, there are many opportunities for players to lose track of the score. Additionally, there are opportunities for players to lose track of other details of the game, such as the team or player that is supposed to serve next. In some cases, this leads to players serving out of order and/or violating other rules. Losing track of the score and/or haphazardly violating other rules creates disputes between players, delays games, and/or decreases the enjoyment of the game among other things. Further, pickleball and other similar sports are commonly played in tournaments and/or other event settings. In a tournament setting, scores and/or other information are commonly tracked across multiple games. Even in tournament play with experienced players, there is a risk for disputes, delays, and/or other issues when scores and/or other details are not tracked correctly across games.

A unique scoring system is configured to track the score, server, and other game information for pickleball and/or other racket games. The system generally includes a scoreboard that is configured to track and display the score throughout the game. The scoreboard is further configured to track and display the serving team, serving player, and/or other game information. By tracking and displaying such information, the scoreboard allows players to focus on playing the game and ensures that players know the correct state of the game. In one version, the scoreboard is configured to provide audible alerts to the players. For example, the scoreboard is configured to audibly announce the scores and the serving player before each serve. Customarily in pickleball and other sports, the serving player is expected to state the scores and/or the serving player before the serve. However, there is a chance the player forgets to state this information or incorrectly states this information. There is also a chance for player to be confused by the scoring in pickleball since this depends on a variety of factors and changes based on the rules set being used. Announcing the score and server through the scoreboard ensures that players are aware of the correct game state before each serve. Further, reminding players of the score, server, and/or other information lessens the chances for disputes and helps players follow the rules of the game. For inexperienced players, such reminders generally help players learn the rules related to serving and scoring. In some examples, the scoreboard allows users to customize the rules and/or other settings. For instance, the scoreboard is configured to communicate with an application on a mobile device that allows users to customize various settings on the scoreboard.

The system further includes one or more remote controls. The remote control generally allows the players and/or an official to control the scoreboard wirelessly. The remote control is configured to connect to the scoreboard using radio waves, Bluetooth®, Wi-Fi, and/or another form of wireless communication. In one example, the remote control is in the form of a fob. The fob is generally a compact device with a small number of buttons to receive user inputs. The fob is configured to attach to the player through a strap, clip, lanyard, chain, and/or in other ways. In one version, the scoreboard is configured to connect up to four fobs. With four fobs, each player in a doubles game has a fob. With two fobs, each team in doubles or each player in singles has a fob. With one fob, one player and/or an official has control of the fob. With multiple fobs, control of the scoreboard generally rotates to the fob of the serving team or player.

The system further includes a data management system (DMS). The DMS is generally a computer that is configured to process scores, game results, performance statistics, and/or other information from multiple games. The DMS is configured to communicate with multiple scoreboards, such as through a wireless connection over radio, Bluetooth®, and/or Wi-Fi for example. In one example, the DMS uses information from the scoreboards to determine ranks for players and/or teams. In another example, the uses the information to match up different players based on skill, either as teammates or as opponents. Further, the DMS provides additional storage for information recorded by the scoreboards. By storing and processing this information, the DMS generally provides many ways for players and teams to track long term performance, compare performances to other similar players and teams, and/or to organize games against other players and teams.

The system is generally expandable to integrate additional display devices and/or multiple scoreboards. By supporting multiple arrangements, the system provides players with a high degree of functionality and flexibility. For example, the system is configured to track and display game information for multiple games, such as for a tournament or other event. In one version, the DMS is configured to manage the tournament. In one example, the system supports at least 12 players, up to 60 players, and/or another tournament size. For example, the DMS is configured to connect to up to 15 scoreboards that are each connected to up to 4 fobs. In one example, the DMS is configured to compute scores, rankings, statistics, and/or other information for individual players and/or teams. In another example, the DMS is configured to arrange matchups, schedule games, and/or perform other logistic tasks for the event.

In one version, each fob stores an identifier that is associated with a particular player and/or team. As some examples, the identifier includes a color, a player name, a team name, a logo, and/or other indicia that is associated with the player and/or team. The scoreboard and/or DMS are configured to display the identifier to clearly denote information for that player and/or team. For instance, the scoreboard is configured to display the score for each team in a color associated with that team. Further, identifying the players and/or teams through the fobs allows the DMS to seamlessly track player and/or team performance, statistics, rankings, and/or other information across multiple games.

In one version, the scoreboard is configured to connect to one or more external displays, such as a screen, a projector, a video wall, and/or a jumbotron as some examples. For example, the scoreboard is configured to wirelessly communicate a video signal and/or other display signal to an external display, such as through Wi-Fi and/or Bluetooth®. Displaying the score and/or other information on a larger external display allows players, officials, and/or spectators to better view that information compared to the smaller display on many traditional scoring devices. Further, connecting the scoreboard to additional displays allows the score to be visible in multiple locations, such as at multiple places around a pickleball court and/or at a centralized location at an event. In one example, game information from multiple scoreboards is displayed at a centralized location along with information about the tournament matchups, player statistics, and/or other event information.

The systems and techniques as described and illustrated herein concern a number of unique and inventive aspects. Some, but by no means all, of these unique aspects are summarized below.

Aspect 1 generally concerns a system.

Aspect 2 generally concerns the system of any previous aspect including a pickleball scoring system.

Aspect 3 generally concerns the system of any previous aspect in which the system is configured to track scores in a game of pickleball.

Aspect 4 generally concerns the system of any previous aspect including a scoreboard configured to track scoring.

Aspect 5 generally concerns the system of any previous aspect in which the scoreboard is configured to visually indicate a score.

Aspect 6 generally concerns the system of any previous aspect in which the scoreboard is configured to receive a first input and a second input from a user.

Aspect 7 generally concerns the system of any previous aspect including a remote control.

Aspect 8 generally concerns the system of any previous aspect including a remote control wirelessly connected to the scoreboard.

Aspect 9 generally concerns the system of any previous aspect in which the remote control is configured to wirelessly communicate with the scoreboard.

Aspect 10 generally concerns the system of any previous aspect including a fob.

Aspect 11 generally concerns the system of any previous aspect in which the remote control includes a fob.

Aspect 12 generally concerns the system of any previous aspect in which the fob includes an input device.

Aspect 13 generally concerns the system of any previous aspect in which the remote control includes a mobile device.

Aspect 14 generally concerns the system of any previous aspect in which the scoreboard includes an input device.

Aspect 15 generally concerns the system of any previous aspect in which the scoreboard includes a display.

Aspect 16 generally concerns the system of any previous aspect in which the display is configured to display a first score.

Aspect 17 generally concerns the system of any previous aspect in which the display is configured to display a second score.

Aspect 18 generally concerns the system of any previous aspect in which the display is configured to display which player is serving.

Aspect 19 generally concerns the system of any previous aspect in which the display includes a first team score display.

Aspect 20 generally concerns the system of any previous aspect in which the display includes a second team score display.

Aspect 21 generally concerns the system of any previous aspect in which the display includes a server number display.

Aspect 22 generally concerns the system of any previous aspect in which the first team score display is configured to indicate a score for the serving team.

Aspect 23 generally concerns the system of any previous aspect in which the second team score display is configured to display a score for the receiving team.

Aspect 24 generally concerns the system of any previous aspect in which the server number display is configured to indicate whether the first server or second server is up to serve.

Aspect 25 generally concerns the system of any previous aspect in which the display includes a display screen.

Aspect 26 generally concerns the system of any previous aspect in which the first team score display, the second team score display, and the server number display are integrated into the display screen.

Aspect 27 generally concerns the system of any previous aspect in which the scoreboard is configured to track scores for teams playing a game.

Aspect 28 generally concerns the system of any previous aspect in which the team includes one or more players.

Aspect 29 generally concerns the system of any previous aspect in which the players are organized onto two teams.

Aspect 30 generally concerns the system of any previous aspect in which the one team begins the game as a serving team and the other team begins the game as a receiving team.

Aspect 31 generally concerns the system of any previous aspect in which the serving team includes a first server and a second server.

Aspect 32 generally concerns the system of any previous aspect in which the scoreboard is configured to score a game of pickleball.

Aspect 33 generally concerns the system of any previous aspect in which the scoreboard is configured to increase a score of a serving team when receiving the first input.

Aspect 34 generally concerns the system of any previous aspect in which the scoreboard is configured to change a server when receiving the second input.

Aspect 35 generally concerns the system of any previous aspect in which the scoreboard is configured to audibly announce the scoring before a player serves.

Aspect 36 generally concerns the system of any previous aspect in which the remote control is portable and configured to be held by a user.

Aspect 37 generally concerns the system of any previous aspect in which the remote control is configured to receive inputs from the user.

Aspect 38 generally concerns the system of any previous aspect in which the input device includes a first button.

Aspect 39 generally concerns the system of any previous aspect in which the fob is configured to send the first input to the scoreboard when the first button is pressed.

Aspect 40 generally concerns the system of any previous aspect in which the input device includes a second button.

Aspect 41 generally concerns the system of any previous aspect in which the fob is configured to send the second input to the scoreboard when the second button is pressed.

Aspect 42 generally concerns the system of any previous aspect including an external display.

Aspect 43 generally concerns the system of any previous aspect in which the scoreboard is configured to connect to an external display.

Aspect 44 generally concerns the system of any previous aspect in which the scoreboard is configured to connect to the external display over a wireless connection.

Aspect 45 generally concerns the system of any previous aspect in which the external display includes a television.

Aspect 46 generally concerns the system of any previous aspect in which the external display includes a tablet.

Aspect 47 generally concerns the system of any previous aspect including a data management system (DMS).

Aspect 48 generally concerns the system of any previous aspect in which the data management system (DMS) includes a computer.

Aspect 49 generally concerns the system of any previous aspect in which the DMS is configured to communicate with multiple scoreboards.

Aspect 50 generally concerns the system of any previous aspect in which the DMS is wirelessly connected to the scoreboard.

Aspect 51 generally concerns the system of any previous aspect in which the scoreboard is configured to send scores and a game result to the DMS.

Aspect 52 generally concerns the system of any previous aspect in which the DMS is configured to process information recorded from multiple games.

Aspect 53 generally concerns the system of any previous aspect in which the DMS is configured to determine a game schedule for an event based on the game results.

Aspect 54 generally concerns the system of any previous aspect in which the DMS is configured to determine a player ranking.

Aspect 55 generally concerns the system of any previous aspect in which the DMS is connected to an external display.

Aspect 56 generally concerns the system of any previous aspect in which the DMS is configured to display a game schedule on the external display.

Aspect 57 generally concerns the system of any previous aspect in which the DMS is configured to display team standings on the external display.

Aspect 58 generally concerns the system of any previous aspect in which the DMS is configured to determine team standings.

Aspect 59 generally concerns the system of any previous aspect in which the remote control is configured to store an identifier.

Aspect 60 generally concerns the system of any previous aspect in which the identifier includes information associated with a player and/or a team.

Aspect 61 generally concerns the system of any previous aspect in which the remote control is configured to transmit the identifier to the DMS through the scoreboard.

Aspect 62 generally concerns the system of any previous aspect in which the identifier includes a color associated with a player and/or a team.

Aspect 63 generally concerns the system of any previous aspect in which the scoreboard is configured to display the scoring for each team using a color associated with that team.

Aspect 64 generally concerns the system of any previous aspect in which the scoreboard is configured to indicate which player is serving using a color associated with that player.

Aspect 65 generally concerns the system of any previous aspect in which the scoreboard is configured to indicate which team is serving using a color associated with that team.

Aspect 66 generally concerns the system of any previous aspect in which the scoreboard is configured to display which player is serving using a color associated with the team of that player.

Aspect 67 generally concerns the system of any previous aspect in which the scoreboard is configured to visually distinguish information related to each team on the display based on the identifier associated with that team.

Aspect 68 generally concerns the system of any previous aspect in which the scoreboard is configured to connect to up to four remote controls.

Aspect 69 generally concerns the system of any previous aspect in which the scoreboard is configured to register inputs from one remote control at a time.

Aspect 70 generally concerns the system of any previous aspect in which the scoreboard is configured to register inputs from the remote control that is controlled by a player currently up to serve.

Aspect 71 generally concerns the system of any previous aspect in which the scoreboard is configured to receive a game mode input.

Aspect 72 generally concerns the system of any previous aspect in which the scoreboard is configured to adjust a game mode in response to the game mode input.

Aspect 73 generally concerns the system of any previous aspect in which the scoreboard is configured to update a score and/or a player that is serving based partly on the game mode.

Aspect 74 generally concerns the system of any previous aspect in which each scoreboards configured to score a game on a separate field of play.

Aspect 75 generally concerns the system of any previous aspect in which the scoreboards configured to update a score based on input from a user.

Aspect 76 generally concerns the system of any previous aspect in which the players at each field of play are organized into two teams.

Aspect 77 generally concerns the system of any previous aspect in which the remote control is configured to wirelessly connect to one of the scoreboards.

Aspect 78 generally concerns the system of any previous aspect in which the remote control is configured to communicate a user input to one of the scoreboards.

Aspect 79 generally concerns the system of any previous aspect in which the remote control is configured to receive an undo input from a user.

Aspect 80 generally concerns the system of any previous aspect in which the remote control is configured to communicate the undo input to the scoreboard.

Aspect 81 generally concerns the system of any previous aspect in which the scoreboard is configured to reverse a change to the scores and/or the serving player in response to the undo input.

Aspect 82 generally concerns the system of any previous aspect in which the DMS is configured to display information related to the multiple games on the external display.

Aspect 83 generally concerns the system of any previous aspect in which the DMS is configured to process information from up to 60 remote controls through the scoreboards.

Aspect 84 generally concerns the system of any previous aspect in which the remote control is configured to receive voice commands from a user.

Aspect 85 generally concerns the system of any previous aspect in which the scoreboard at each field of play is configured to visually distinguish information related to each team at that field of play based on the identifier associated with that team.

Aspect 86 generally concerns the system of any previous aspect in which the scoreboard includes a controller.

Aspect 87 generally concerns the system of any previous aspect in which the remote control includes a controller.

Aspect 88 generally concerns the system of any previous aspect in which the controller includes a processor.

Aspect 89 generally concerns the system of any previous aspect in which the controller includes memory.

Aspect 90 generally concerns the system of any previous aspect in which the scoreboard includes a transceiver.

Aspect 91 generally concerns the system of any previous aspect in which the scoreboard includes a speaker.

Aspect 92 generally concerns the system of any previous aspect in which the scoreboard includes an Energy Storage System (ESS).

Aspect 93 generally concerns the system of any previous aspect in which the remote control includes an Energy Storage System (ESS).

Aspect 94 generally concerns the system of any previous aspect in which the ESS includes a battery.

Aspect 95 generally concerns the system of any previous aspect in which the remote control includes a transceiver.

Aspect 96 generally concerns the system of any previous aspect in which the controller is operatively coupled to the display.

Aspect 97 generally concerns the system of any previous aspect in which the transceiver is operatively coupled to the controller.

Aspect 98 generally concerns the system of any previous aspect in which the controller is operatively coupled to the input device.

Aspect 99 generally concerns the system of any previous aspect in which the speaker is operatively coupled to the controller.

Aspect 100 generally concerns the system of any previous aspect in which the transceiver of the remote control is configured to wirelessly communicate with the transceiver of the scoreboard.

Aspect 101 generally concerns the system of any previous aspect in which the speaker is configured to audibly announce the scoring before service.

Aspect 102 generally concerns the system of any previous aspect in which the controller is configured to track the scoring.

Aspect 103 generally concerns the system of any previous aspect in which the display is operatively coupled to the controller.

Aspect 104 generally concerns the system of any previous aspect in which the remote control is a handheld type device.

Aspect 105 generally concerns the system of any previous aspect in which the remote control is configured to communicate with the scoreboard using a short-range communication protocol.

Aspect 106 generally concerns the system of any previous aspect in which the remote control is not a mobile device.

Aspect 107 generally concerns the system of any previous aspect in which the remote control is not a smartphone.

Aspect 108 generally concerns the system of any previous aspect in which the display is configured to display the scoring.

Aspect 109 generally concerns the system of any previous aspect in which the scoreboard is configured to track scoring of a pickleball game.

Aspect 110 generally concerns the system of any previous aspect in which the remote control is configured to transmit a wireless signal to the transceiver of the scoreboard to update the scoring.

Aspect 111 generally concerns the system of any previous aspect in which the controller is configured to update the scoring on the display in response to receiving the wireless signal from the remote control.

Aspect 112 generally concerns the system of any previous aspect including at least two scoreboards configured to track scores for teams playing a game.

Aspect 113 generally concerns the system of any previous aspect in which the scoreboard is configured to receive a first input and a second input from the remote control.

Aspect 114 generally concerns the system of any previous aspect in which the scoreboard is configured to audibly announce via the speaker the scoring before a player serves.

Aspect 115 generally concerns the system of any previous aspect in which the scoreboards include a display.

Aspect 116 generally concerns the system of any previous aspect in which the DMS is configured to communicate with the scoreboards.

Aspect 117 generally concerns the system of any previous aspect in which the scoreboards are configured to send scores and game results to the DMS.

Aspect 118 generally concerns the system of any previous aspect in which the controller is configured to determine changes to the scoring in response to receiving the wireless signal from the remote control.

Aspect 119 generally concerns the system of any previous aspect in which the controller is configured to update the display in response to changes to the scoring.

Aspect 120 generally concerns the system of any previous aspect in which the first input is a score input.

Aspect 121 generally concerns the system of any previous aspect in which the second input is a fault input.

Aspect 122 generally concerns the system of any previous aspect in which the first input is associated with a first team.

Aspect 123 generally concerns the system of any previous aspect in which the second input is associated with a second team.

Aspect 124 generally concerns the system of any previous aspect in which the scoreboard is configured to communicate with a mobile device.

Aspect 125 generally concerns the system of any previous aspect in which the scoreboard is configured to adjust one or more settings on the scoreboard based on communication with the mobile device.

Aspect 126 generally concerns the system of any previous aspect in which the scoreboard is configured to update the scoring as a standalone device.

Aspect 127 generally concerns the system of any previous aspect in which the scoreboard is self-contained.

Aspect 128 generally concerns the system of any previous aspect in which the scoreboards configured to score a game occurring at a different field of play and/or at a different time.

Aspect 129 generally concerns the system of any previous aspect in which the scoreboards are configured to send information recorded during the game to the DMS.

Aspect 130 generally concerns the system of any previous aspect in which the scoreboards are configured to send information about player performance to the DMS.

Aspect 131 generally concerns the system of any previous aspect in which the DMS is configured to determine rankings based on the information about the player performance.

Aspect 132 generally concerns the system of any previous aspect in which the DMS is configured to match players together based on a skill level of each player.

Further forms, objects, features, aspects, benefits, advantages, and embodiments of the present invention will become apparent from a detailed description and drawings provided herewith.

DETAILED DESCRIPTION OF SELECTED EMBODIMENTS

Figure 1:
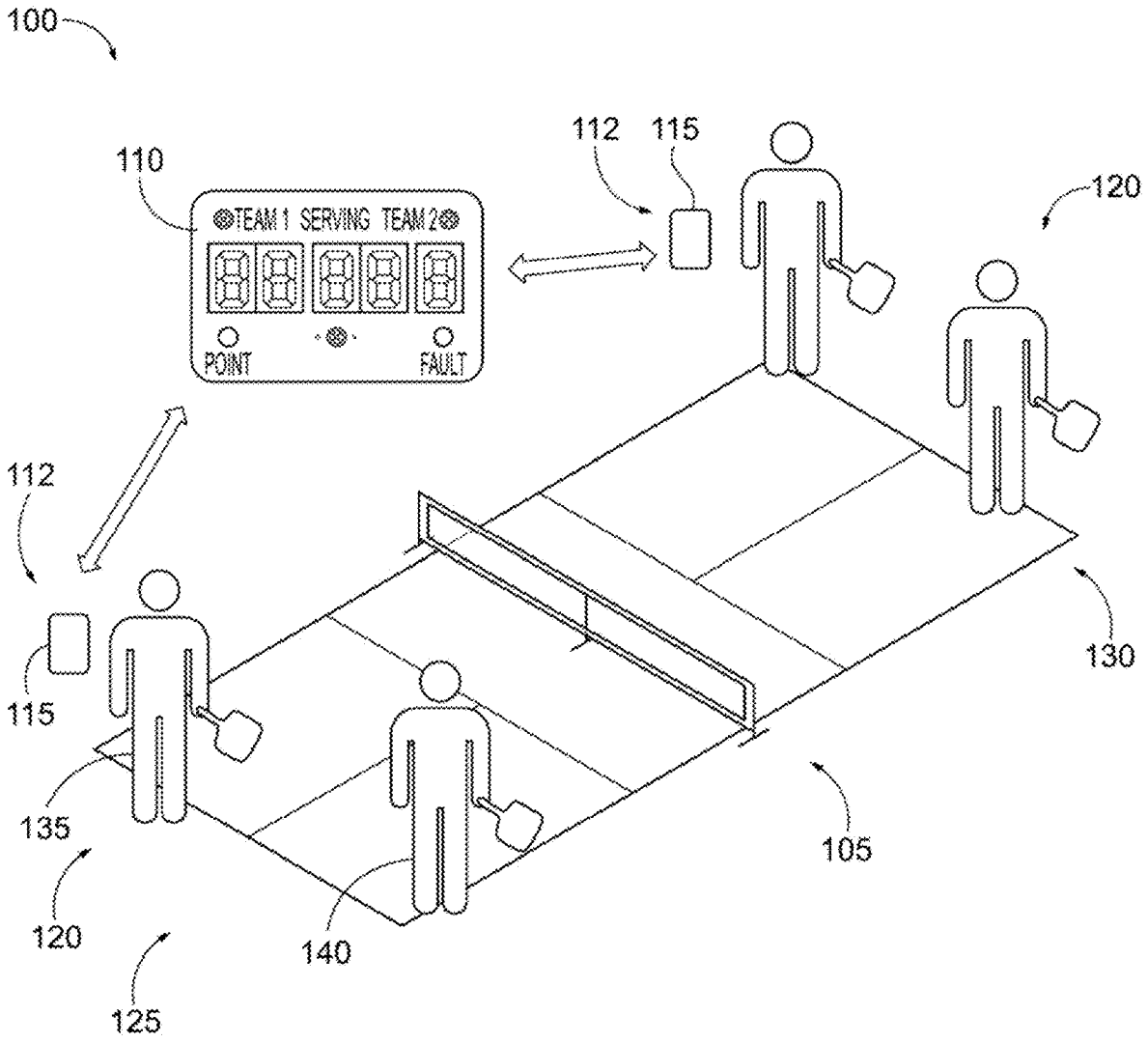
FIG. 1 is a perspective view of a pickleball scoring system according to one example.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

The reference numerals in the following description have been organized to aid the reader in quickly identifying the drawings where various components are first shown. In particular, the drawing in which an element first appears is typically indicated by the left-most digit(s) in the corresponding reference number. For example, an element identified by a "100" series reference numeral will likely first appear in FIG. 1, an element identified by a "200" series reference numeral will likely first appear in FIG. 2, and so on.

Referring to FIG. 1, a scoring system 100 is configured to track the score and other game information for pickleball and/or other racket games. Ordinarily, players must mentally keep track of game information, including the score, the team that is serving, the player that is serving, and/or other information. The system 100 allows players to record points, faults, and/or other changes to the state of the game. Tracking the game in this way can eliminate disputes between players and can allow players to focus on playing the game rather than remembering the score. Further, the system 100 helps players to follow the rules of the game and for new players to learn the rules. For example, pickleball rules are often prone to cause confusion because the scoring and server changes are based on the player serving, the team serving, the serving order among players, and the result of the rally. To further complicate the scoring, the scoring scheme can change based on the number of points scored by the teams, the result of a rally mid-game, and the set of pickleball rules being used. For instance, pickleball can be played according to various rule sets such as side-out scoring, rally scoring, Major League Pickleball team rules, and Minor League Pickleball team rules as some examples. There is a chance for both new and experienced players to accidentally apply the rules incorrectly and/or apply the wrong set of rules. The system 100 is configured to track a variety of game details and to update the state of the game according to the chosen rules. By automatically updating the state of the game, the system 100 ensures that the score, server, serving position, and/or other details are correct before each rally begins. In one version, the system 100 is configured to alert players when the score, server, and/or other game information changes, such as through visual and/or auditory alerts. For example, the system 100 is configured to audibly announce the score and/or the server when a player updates any of that information. By providing feedback to the players, the system 100 ensures that players know the state of the game before each serve. As should be appreciated, the system 100 can be used to track the score for other types of games besides racket sports.

As shown in FIG. 1, the system 100 is generally used at a field of play 105. In the illustrated example, the field of play 105 is a pickleball court. In other examples, the field of play 105 includes a tennis court, a table tennis table, and/or another space arranged for playing a game or sport. The system 100 generally includes a scoreboard 110 and a remote control 112. The scoreboard 110 is configured to store game information, receive inputs to update game information, and/or display the game information. For instance, the scoreboard 110 is configured to display a score for each team and a current server. The scoreboard 110 provides a standalone solution for tracking the state of the game, computing updates to the state of the game after each rally, and displaying game information. In other words, the scoreboard 110 is a standalone device configured to perform all the necessary computations to update the state of the game in response to an input. In one example, the scoreboard 110 is further configured to perform all the necessary actions to store game data and/or display the state of the game as a standalone device. The scoreboard 110 is further configured to calculate player and/or team statistics, store information about player and/or team performances, and/or process game data in other ways. Using a self-contained scoreboard 110 allows players to utilize just a single device to track and display the state of the game. In contrast, many other scoring systems require additional devices beyond a scoreboard to compute score updates, provide inputs, store data, and/or perform other tasks. For instance, other systems commonly require a smartphone, a smart watch, and/or other personal computing devices to perform such tasks. The scoreboard 110 provides all the relevant functionality without requiring players to own or purchase such additional devices. In this way, the scoreboard 110 is more accessible and offers a more streamlined game tracking solution than other scoring systems.

The remote control 112 is generally a portable wireless device that is carried by a user 120 during play. The remote control 112 is communicatively connected to the scoreboard 110, such as through radio frequency (RF) signals, Bluetooth®, Wi-Fi, and/or other forms of wireless communication. The remote control 112 is configured to receive an input from a user 120, such as to denote when a point is scored, when a fault is committed, and/or when a particular team wins a rally. The remote control 112 then communicates a corresponding change in the game state to the scoreboard 110. Using the remote control 112 therefore provides a convenient way for the user 120 to update the game state without having to walk over to the scoreboard 110 to provide direct inputs. Further, compared to using a smart watch or other type of smart device to update the game state, the remote control 112 is typically better adapted for providing inputs for the scoreboard 110. For instance, the remote control 112 allows the user 120 to provide inputs through a fixed arrangement of buttons and/or other physical input devices rather than having to run and/or configure an application on a smart device. Additionally, during play, the user 120 is less likely to accidentally press the tactile buttons on the remote control 112 than a touchscreen on a smart device.

In the illustrated example, the remote control 112 includes a fob 115. The fob 115 is generally a compact wireless device having a small number of inputs. In one example, the fob 115 is configured to receive only two inputs, such as a score input and a fault input, or an input for each team as a couple examples. In some examples, the fob 115 is configured to simply receive inputs and communicate with the scoreboard 110 and has little or no additional functions. The fob 115 is generally easier and less intrusive for a player to carry during the game compared to larger types of the remote control 112. Further, the fob 115 provides a simplified way to communicate with the scoreboard 110 that minimizes distractions and allows the user 120 to quickly select an input. For the purposes of explanation, the remote control 112 will be generally described in the form of the fob 115, but it should be recognized that the remote control 112 can come in other forms. As should be appreciated, the system 100 is configured to include the remote control 112 in a variety of forms. In the illustrated example, the system 100 includes two fobs 115 that are each controlled by a user 120. The scoreboard 110 is configured to communicate with one, two, three, four, and/or another number of fobs 115. For instance, each player, each team, and/or an official each have one fob 115 that is configured to communicate with the scoreboard 110. Alternatively or additionally, the scoreboard 110 is configured to receive inputs directly from the user 120 without the fob 115, such as through buttons and/or other input devices on the scoreboard 110.

In one version, the scoreboard 110 is configured to communicate with a user device, such as a mobile device, smartphone, tablet, and/or personal computer. The scoreboard 110 is typically configured to connect to the user device wirelessly, such as through Bluetooth®, Wi-Fi, and/or other forms of wireless communication. In an alternative example, the scoreboard 110 is configured to connect to the user device through a wired connection, such as through a USB cable. The user device typically allows users 120 to customize various settings on the scoreboard 110. For example, the user device allows users 120 to select the desired set of rules, scoring scheme, display settings, and/or other parameters used by the scoreboard 110. The scoreboard 110 is configured to maintain the same settings after customization. Therefore users 120 only have to adjust the settings one time to configure the scoreboard 110 for all subsequent uses. Connecting to the device also allows the scoreboard 110 to transfer stored data about game outcomes, player performance, and/or other information. For example, the scoreboard 110 is configured to transfer data about player performance to an application on a mobile device. In one example, the application uses the data to determine player rankings, match players based on skill, and/or organize league matches as some examples. In another example, the scoreboard 110 is configured to communicate such data to a remote server and/or other type of cloud storage.

The system 100 is generally expandable to connect to additional displays and/or to integrate multiple scoreboards 110. By supporting multiple arrangements, the system 100 provides a high degree of functionality and flexibility for the users 120. For example, the system 100 is configured to track and display game information for multiple games, such as for a tournament or other event. In one version, the system 100 is configured to record the performance of teams and/or players across multiple games. The system 100 is generally expandable from a single scoreboard 110 and set of fobs 115. In one example, the system 100 includes multiple scoreboards 110 each used to track a game at a different field of play 105. In such an example, the scoreboards 110 are connected over a network and/or through another device and are configured to provide game information to a centralized location. In another example, the system 100 is configured to identify and track the performance of each player and/or team. For instance, each fob 115 is associated with a particular player or a particular team. Further, the scoreboard 110 is configured to denote the player or team by using a unique color associated with that player and/or team, displaying a player and/or team name, and/or displaying a logo or other indicia as some examples. Identifying each player or team allows the system 100 to seamlessly track the performance of the player or team across multiple games. Further, tracking individualized performances allows the system 100 to update team standings, stat leaderboards, game results, upcoming matchups, and/or other information gathered across multiple games over time and/or at multiple fields of play 105.

In one version, the scoreboard 110 is configured to connect to one or more external displays, such as a screen, a projector, and/or a jumbotron as some examples. In one example, game information from multiple scoreboards 110 is displayed at a centralized location along with information about the tournament matchups, player statistics, and/or other event information. In another example, the score and/or other game information is displayed at the field of play 105 on the external device. Displaying the score and/or other information on a larger external display allows players, officials, and/or spectators to better view that information compared to the smaller display on many traditional scoring devices. Further, connecting the scoreboard 110 to additional displays allows the score to be visible in multiple locations, such as at multiple places near the field of play 105 and/or at a centralized location between multiple fields of play 105.

In many cases, the users 120 are arranged into teams. In the illustrated example, the users 120 are organized into a serving team 125 and a receiving team 130. In pickleball and other racket games, the serving team 125 switches throughout the game. The scoreboard 110 is configured to indicate which team is the serving team 125, such as through a visual display and/or an auditory announcement. The system 100 supports play between two users 120 (i.e., singles), four users 120 (i.e., doubles), and/or other numbers of users 120. In the FIG. 1 example, the users 120 are arranged for doubles, and there are two users 120 on the serving team 125. The serving team 125 includes a first server 135 and a second server 140. In pickleball and other games, the user 120 on the serving team 125 that serves the ball can change, such as if the first server 135 faults during a serve. The system 100 is configured to track which user 120 is serving. Further, the scoreboard 110 is configured to indicate whether the first server 135 or the second server 140 is currently up to serve. For instance, the scoreboard 110 is configured to display a number or other indicator for the serving player and/or to audibly announce which player is serving.

Figure 2:
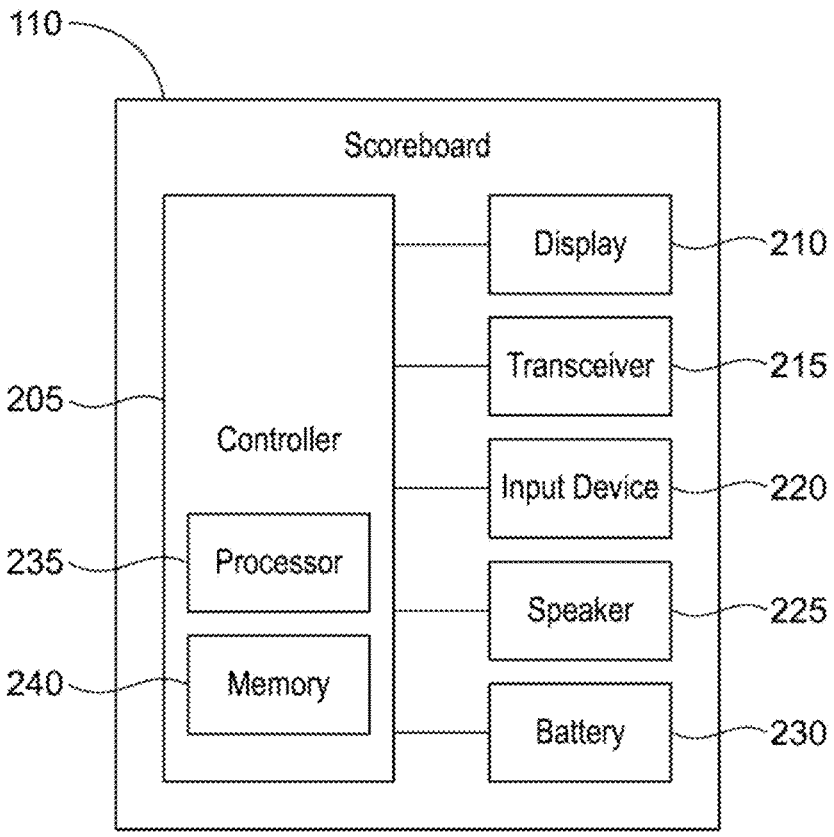
FIG. 2 is a diagram of a scoreboard used in the FIG. 1 system.

Referring to FIG. 2, the scoreboard 110 typically includes a controller 205, a display 210, a transceiver 215, an input device 220, a speaker 225, and an energy storage system (ESS) 230. The controller 205 is electrically connected to and is generally configured to communicate with the other components of the scoreboard 110. The controller 205 is generally configured to store and update information about a game. The controller 205 generally includes a processor 235 and memory 240. In one example, the controller 205 is configured to run software, such as a mobile application. In one example, the controller 205 is configured to store information about one or more sets of rules for a game and to perform algorithms to score the game. Generally, the controller 205 is configured to update the score according to a stored set of rules. For instance, the controller 205 increases the score on every fault when following rally scoring rules. When following traditional scoring rules, the controller 205 increases the score only on faults by the receiving team 130. In one example, the controller 205 determines that a game has concluded when a winning score and/or other win conditions have been met. For instance, the controller 205 is configured to end the game when one team reaches a score of eleven and the other team is at least two points down.

The display 210 is configured to visually indicate the score and/or other game information to the users 120. As some examples, the display 210 includes one or more display screens, segment displays, indicator lights, and/or other types of displays. In one example, the display 210 includes multiple separate displays that each provide different information to the users 120. In another example, the display 210 includes one display screen that shows all the information to the users 120. The display 210 is typically large enough for users 120 to read the information from across the field of play 105. For instance, the display 210 is configured to display numbers that are at least two inches tall, three inches tall, four inches tall, and/or another size.

The transceiver 215 is configured to communicate wirelessly with the fob 115 and/or another device. The transceiver 215 is configured to transmit and/or receive signals using radio waves, Bluetooth®, Wi-Fi, and/or other types of communication. In one particular example, the transceiver 215 is configured to communicate with the fob 115, a mobile device (i.e., smartphone, smartwatch, etc.), and/or another device over Bluetooth. The scoreboard 110 primarily uses the transceiver 215 to receive score and other game updates from the user 120. The scoreboard 110 is further configured to use the transceiver 215 to connect to another external device for communicating game information, such as for collecting player rankings, for organizing tournaments, and/or for expanding the display. Alternatively or additionally, the scoreboard 110 is configured to communicate with an external device through a wired connection, such as through a USB, HDMI, and/or other type of cable. As should be appreciated, the scoreboard 110 is configured to utilize the transceiver 215 in a variety of forms and/or to communicate a variety of types of information.

The input device 220 is typically a physical control device that is mounted on the scoreboard 110. The input device 220 allows the user 120 to provide an input directly to the scoreboard 110. In one example, input device 220 includes one or more physical buttons and/or switches that allow the user 120 to change the score, the server, and/or other aspects of the game. In other examples, the input device 220 includes a touchscreen, microphone, and/or other type of device. In some examples, the input device 220 is configured to receive voice commands to change the score, mark a fault, and/or change other aspects of the game.

The speaker 225 is configured to announce information about the game. In some examples, the speaker 225 provides audio feedback to the user 120 in response to an input from the user 120. For example, the speaker 225 is configured to play a noise and/or message that confirms an input from the user 120. For instance, the noise and/or message confirms that a point has been scored, a fault has been committed, the server has changed, the game mode has been changed, and/or another change in the game state. In another example, the speaker 225 is configured to announce the score and/or the current server before each serve. Commonly in pickleball and other games, the server is generally expected to state the score before serving. However, there is a chance that the server forgets to state the score or incorrectly states the score before serving. By announcing this information audibly, the speaker 225 ensures that the users 120 are notified of the correct score before each serve. Further, in pickleball and other games, the server and/or other players change positions on the field of play 105 depending on the score, the server, and/or other factors. By announcing the score and the current server, the speaker 225 allows the users 120 to follow the correct serving order and/or to move to the correct positions on the field of play 105 before the serve. As should be appreciated, the scoreboard 110 is configured to provide audible alerts to the users 120 through the speaker 225 to convey any type of information about the game. In one example, the scoreboard 110 supports multilingual announcements, such as in English and/or French.

In one form, the ESS 230 is a battery. The ESS 230 is electrically connected to and configured to provide power to the other components of the scoreboard 110, including the controller 205. The ESS 230 allows the scoreboard 110 to be portable. The portable nature of the scoreboard 110 allows the users 120 to position the scoreboard 110 at a variety of points around the field of play 105. For instance, the users 120 can place the scoreboard 110 on the ground near the field of play 105, hang the scoreboard 110 on a fence or other structure near the field of play 105, place the scoreboard 110 on a table or other raised surface, and/or position the scoreboard 110 in another way nearby the field of play 105. Further, the portable nature of the scoreboard 110 allows the users 120 to easily relocate the scoreboard 110 to another field of play 105, such as to set up a new game during a tournament and/or to switch to a different type of court as examples.

Figure 3:
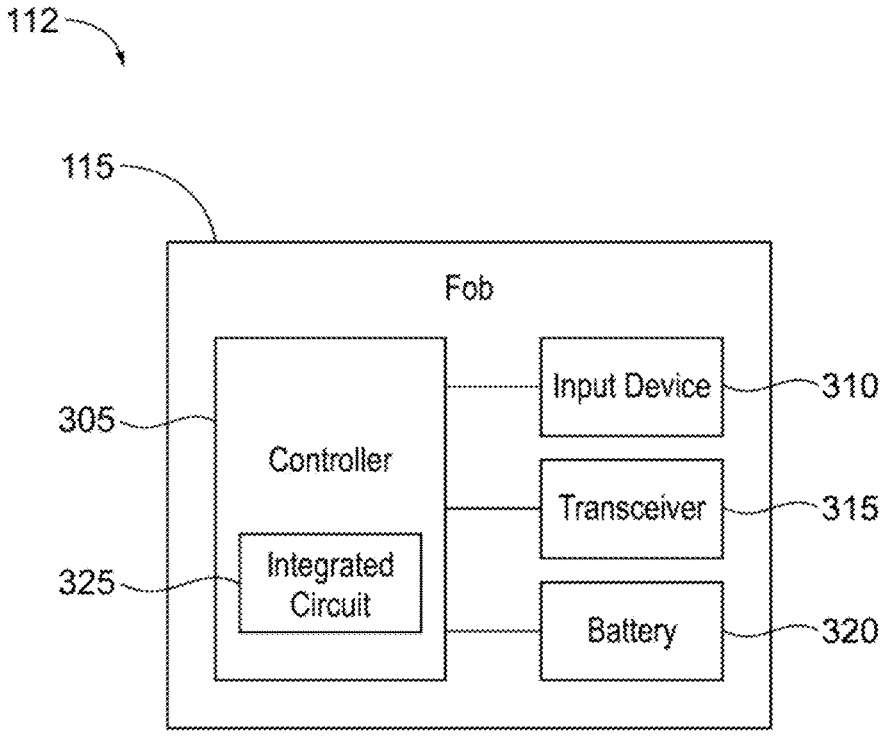
FIG. 3 is a diagram of a fob used in the FIG. 1 system.

Referring to FIG. 3, the fob 115 typically includes a controller 305, an input device 310, a transceiver 315, and an energy storage system (ESS) 320. The controller 305 is electrically connected to and is generally configured to communicate with the other components of the fob 115. The controller 305 is generally configured to process inputs from the user 120 and to communicate with the scoreboard 110 via the transceiver 315. The controller 305 generally includes an integrated circuit (IC) 325. The integrated circuit 325 is typically a relatively simple circuit rather than a processor or other more complex integrated circuit. As some examples, the integrated circuit 325 includes a decoder, encoder, Analog-to-Digital Converter (ADC), Digital-to-Analog Converter (DAC), Static Random-Access Memory (SRAM) chip, Electrically Erasable Programmable Read-Only Memory (EEPROM) chip, amplifier, and/or another simple integrated circuit configured for a particular task. Further, the controller 305 is configured to store a digital player and/or team identifier.

The input device 310 is typically a physical control device that is mounted on the fob 115. The input device 310 generally allows the user 120 to provide an input to the fob 115 that is then communicated to the scoreboard 110. In one example, the input device 310 includes the same type of device as the input device 220 on the scoreboard 110. For example, input device 310 includes one or more physical buttons, switches, touchscreens, microphones, and/or other devices. The input device 310 allow the user 120 to change the score, the server, and/or other aspects of the game. In some examples, the input device 310 is configured to receive voice commands.

The transceiver 315 is configured to transmit and/or receive signals from the scoreboard 110. In one version, the transceiver 315 is the same type of device as the transceiver 215 in the scoreboard 110. For example, the transceiver 315 is configured to communicate using radio waves, Bluetooth®, Wi-Fi, and/or other forms of wireless communication. When the fob 115 receives an input from the user 120 through the input device 310, the transceiver 315 is configured to communicate that input to the scoreboard 110. In some examples, the transceiver 315 is further configured to transmit a player and/or team identifier to the scoreboard 110. In one example, the transceiver 315 is only configured to transmit information.

In one version, the ESS 320 is a battery. The ESS 320 is electrically connected to and configured to provide power to the other components of the fob 115. The fob 115 is generally lightweight and portable. The ESS 320 frees the fob 115 to move around the field of play 105 with the user 120. In one example, the fob 115 uses a relatively low amount of power and the ESS 320 is small and lightweight. Using a small ESS 320, such as a coin or button cell battery, allows the fob 115 to have little to no impact on the user 120 during play. For instance, the fob 115 is hardly noticeable, if at all, to the user 120 during play.

Figure 4:
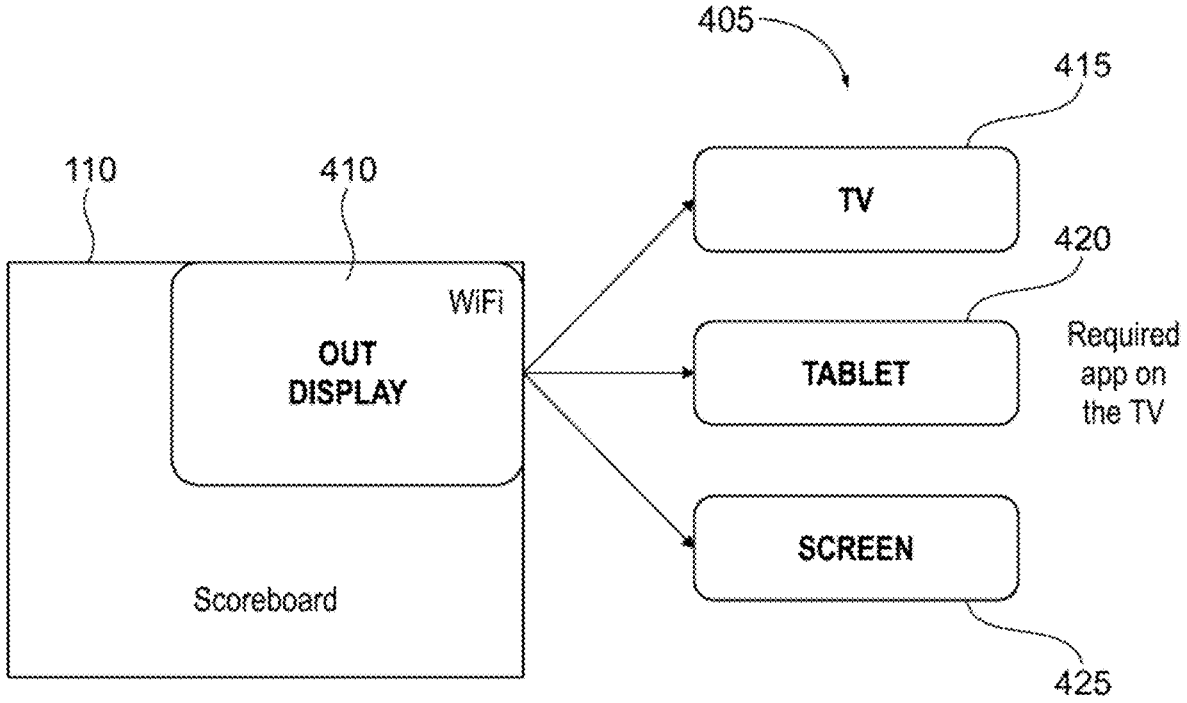
FIG. 4 is a diagram of the FIG. 2 scoreboard communicating with an external display device.

Referring to FIG. 4, the scoreboard 110 is further configured to connect to an external display device 405. The external display device 405 is generally configured to display information about an ongoing game, players, teams, an event, and/or other information. In one example, the external display device 405 displays the same information as the display 210. The external display device 405 is typically larger than the display 210 such that the score, server, and/or other information is more visible to the users 120. In another example, the external display device 405 displays supplemental information. As an example, the display 210 is configured to display the score and the server, and the external display device 405 is configured to display information about the players, teams, and/or other games in a tournament. In some examples, the scoreboard 110 is configured to connect to multiple external display devices 405 at the same time, such as for displaying information at multiple locations. Further, in some examples, the external display device 405 includes speakers and is configured to play audio alerts from the scoreboard 110. In another example, the external display device 405 includes an application that communicates with the scoreboard 110 and/or processes information that is displayed.

The scoreboard 110 includes a display output module 410 configured to communicate with the external display device 405. The display output module 410 is configured to wirelessly transmit a video or other display signal to the external display device 405, such as using Wi-Fi, Bluetooth®, and/or other forms of wireless communication. In one example, the display output module 410 is part of the transceiver 215. Alternatively, the display output module 410 supports a wired connection between the scoreboard 110 and the external display device 405, such as through USB, HDMI, and/or other cables.

As shown in FIG. 4, the external display device 405 includes a television 415, a tablet 420, and/or a screen 425 as some examples. As should be appreciated, the scoreboard 110 is configured to connect to the external display device 405 having any form. The television 415 is generally a standalone device having a self-contained screen. As some examples, the television 415 includes a Cathode Ray Tube display (CRT), Light-Emitting Diode display (LED), Plasma Display Panel (PDP), Liquid Crystal Display (LCD), Organic Light-Emitting Diode display (OLED), or other type of display. In one example, the television 415 includes a computer and is configured to run software and/or applications. For instance, the television 415 is a smart TV. Alternatively, the television 415 is connected to and configured to receive a display signal from a streaming device, digital media player, and/or other type of device. In that example, the display output module 410 is configured to communicate with an application on the television 415 and/or a connected device. The size of the television 415 can vary. In one example, the diagonal distance between corners on the screen of the television 415 is between 32 inches and 85 inches. In other examples, the diagonal distance is up to 24 inches, 32 inches, 40 inches, 50 inches, 55 inches, 60 inches, 65 inches, 70 inches, 75 inches, 80 inches, greater than 85 inches, and/or another size. Expanding the display to the television 415 is generally a convenient option for the users 120 when using the system 100 at home, for casual play, and/or for small events.

The tablet 420 is generally a portable computer having a predominant screen. Commonly, the tablet 420 includes a touchscreen and no other input devices, allowing the screen to span across most or all of the device. Typically, the tablet 420 is configured to run software and/or applications that communicate with the display output module 410. The size of the tablet 420 can vary. In one example, the diagonal distance between corners on the screen of the tablet 420 is between 7 inches and 13 inches. In other examples, the diagonal distance is up to 7 inches, 9 inches, 10 inches, 11 inches, 13 inches, 15 inches, 17 inches, greater than 20 inches, and/or another size. Expanding the display to the tablet 420 is generally a convenient option for the users 120 when using the system 100 at home and/or for casual play. Because the tablet 420 is portable, the tablet 420 allows the users 120 to easily relocate the tablet 420 at different points around the field of play 105 and/or to other fields of play 105 at different locations.

The screen 425 is a device that is configured to display various types of video and/or other visual information. As some examples, the screen 425 includes a large-screen television (i.e., jumbotron), a video wall, a projector and projector screen, a computer monitor, and/or another type of device. In one example, the screen 425 includes multiple televisions and/or monitors that are tiled and/or otherwise arranged to form a larger display. The size of the screen 425 can vary. In some examples, the screen 425 is around the same size or smaller than the television 415. For instance, the diagonal distance between corners on the screen 425 is up to 24 inches, up to 50 inches, up to 85 inches, and/or another size. In other examples, the screen 425 is larger than the television 415. For instance, the diagonal distance is greater than 85 inches, greater than 100 inches, greater than 110 inches, greater than 30 feet, greater than 60 feet, greater than 100 feet, and/or another size. In one example, the screen 425 is a permanent display fixture in a gymnasium, arena, and/or other event space. Expanding the display to the screen 425 generally facilitates displaying information to the users 120 and/or other spectators at official tournaments and/or other larger events. Further, using the screen 425 allows a much larger amount of information to be displayed than using just the display 210 on the scoreboard 110.

Figure 5:
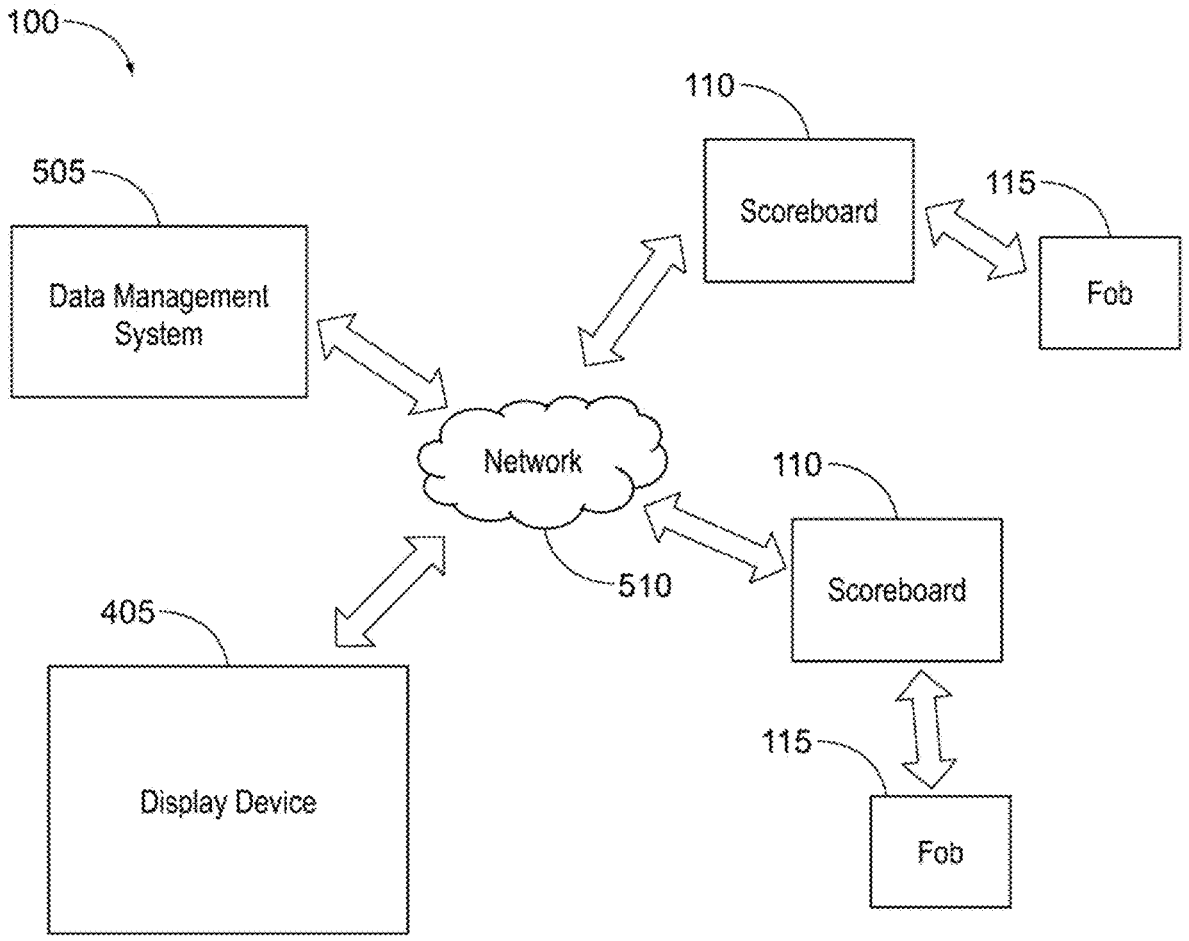
FIG. 5 is a diagram of the FIG. 1 system according to another example.

Referring to FIG. 5, the system 100 further includes a data management system 505 in one version. The data management system 505 generally includes a computer, controller, and/or other similar device. For instance, the data management system 505 is a server, a computer network, and/or a personal computer in some examples. The data management system 505 is generally configured to receive and process game information from multiple scoreboards 110. As some examples, the data management system 505 is configured to track the individual performance of players, track the performance of teams, determine upcoming matchups based on game outcomes, determine an order of play for games, and/or organize other information about the tournament. As shown, the data management system 505 is configured to connect to the scoreboards 110 through a network 510. The network 510 is typically a Wi-Fi network, the Internet, and/or another type of network. The network 510 allows the scoreboards 110 to wirelessly upload data to the data management system 505. For example, the data management system 505 provides cloud storage for the scoreboards 110 that is accessible through the network 510. In some example, the scoreboards 110 are configured to send information to the data management system 505 automatically, such as in regular intervals and/or when storage on the scoreboard 110 is filled. In another example, the scoreboard 110 allows the user 120 to select data to send to the data management system 505, such as through an application on a mobile device and/or controls on the scoreboard 110. In yet another example, the scoreboard 110 is further configured to send data to the data management system 505 through the application on the mobile device.

The data management system 505 is configured to utilize data from the scoreboards 110 in a variety of ways. In one version, the data management system 505 stores and processes data from multiple teams and players for general use. As some examples, the data management system 505 is configured to calculate player and/or team ranks, match players together on a team based on skill level, determine player and/or team matchups based on skill level, aggregate player and/or team statistics across multiple games, and/or determine league positions of players and/or teams. For instance, the data management system 505 allows players and/or teams to find partners and/or opponents for casual matchups based on skill level. In another example, the data management system 505 allows players and/or teams to track performance and determine matchups for casual or competitive league play. Further, the data management system 505 allows players and/or teams to be ranked within a larger pool of players and/or teams. In one example, the data management system 505 is configured to communicate information to an application on a user device to allow the users 120 to view rankings and/or find other players among other functions. In another version, the data management system 505 is configured to organize a tournament and/or other event with multiple games. For example, the data management system 505 is configured to determine a schedule of play, rank player and/or team performance for the event, and/or track player and/or team stats across the event among other examples. In yet another version, the data management system 505 is configured to track and store long term data about player and/or team performance for personal or private use. As should be appreciated, the data management system 505 is configured to store any type of data from the scoreboards 110 and/or to process the data in any combination of ways and for any combination of purposes.

In the illustrated example, the data management system 505 is configured to connect to one or more external display devices 405. The data management system 505 is configured to display a variety of information on the external display device 405. In one example, the data management system 505 is configured to connect to the external display device 405 wirelessly, such as through the network 510, the display output module 410, and/or another device. In another example, the data management system 505 is connected to the external display device 405 through a wired connection. Connecting to the external display device 405 in this way generally helps display a wider breadth of information outside of a single game, such as in a tournament or other event setting.

As shown, the system 100 is generally expandable to utilize multiple scoreboards 110. Each scoreboard 110 is configured to connect to a separate set of fobs 115. In one version, the system 100 is expandable to support at least 12 players. For instance, the system 100 includes at least three scoreboards 110 that each connect to four fobs 115 and/or otherwise allow four players to participate. In another version, the system 100 is expandable to support up to 60 players. For instance, the system 100 includes up to fifteen scoreboards 110. Accordingly, the data management system 505 is configured to communicate with and process information from up to three, up to five, up to ten, up to fifteen, more than fifteen, and/or another number of scoreboards 110. The data management system 505 provides a high degree of flexibility to players, game officials, and/or event organizers to handle events with various numbers of teams, players, games, and/or in various arrangements. For instance, the data management system 505 supports a variety of tournament styles, such as round robin, single elimination, double elimination, and/or any other format. Further, the scoreboard 110 is versatile for both recreational and competitive use. The scoreboard 110 allows the users 120 to score an individual game as a standalone unit and/or score and track a game as a part of an event. Therefore, the system 100 is configured to score games in a variety of settings and for a variety of purposes.

The data management system 505 and the scoreboards 110 are generally configured to display and/or track different information. In one example, the data management system 505 is positioned at a central location at an event space, such as between multiple fields of play 105, above the fields of play 105, away from the fields of play 105, and/or in another location. As noted, the scoreboards 110 generally display information related to a single ongoing game. For instance, the scoreboards 110 display the score for each team or individual player, the current server, and/or other game information. In contrast, the data management system 505 generally displays information about an event that is aggregated over multiple games and/or related to tournament organization. For example, the data management system 505 shows standings, play orders, and/or opponent and partner schedules. As some other examples, the data management system 505 displays statistics across multiple games, upcoming matchups, game results, team standings, and/or individual player standings. In a particular example for a round robin style tournament, the data management system 505 displays player names, status as a team or individual, number of player or teams, and/or information about preliminary rounds. In one version, the data management system 505 automatically updates the displayed information when receiving new information about participants and/or game outcomes. Further, in some examples, the scoreboards 110 and not the data management system 505 are configured to provide audible alerts, such as announcing the score and the server before a new serve. Announcing such information through the scoreboard 110 provides relevant game information to players at the corresponding field of play 105. However, there is a chance for audio alerts from the data management system 505 to interfere with announcements from the scoreboard 110 and/or distract players. Alternatively, the data management system 505 is configured to provide tournament-wide updates through audible announcements.

In one example, the scoreboard 110 is configured to transmit information about the team and/or player that is received via the fob 115. For example, the fob 115 stores an identifier for the player, an identifier for the team, and/or other information specific to the player and/or team. The fob 115 is configured to provide such information to the data management system 505 through the scoreboard 110. For instance, the scoreboard 110 is configured to communicate the result of a game, the final score, and/or player identifiers after a game concludes. Further, the data management system 505 and/or the scoreboard 110 store a unique color, name text, and/or a design associated with each player and/or team. In one example, the scoreboard 110 is configured to display the score, serve, and/or other information using the color associated with the player and/or team. In another example, the scoreboard 110 is configured to display a name and/or design for each player and/or team in a game. Additionally or alternatively, the data management system 505 stores information about the players and/or teams, such as in a database. Such information generally includes team identifiers, player identifiers, and/or statistics as some examples. In another example, the scoreboard 110 is configured to record points scored, faults committed, wins, and/or other information about the performance of a player. The scoreboard 110 is configured to transmit that information to the data management system 505. By identifying players and/or teams, the data management system 505 is configured to seamlessly attribute information from multiple games to the correct players and/or teams.

Figure 6:
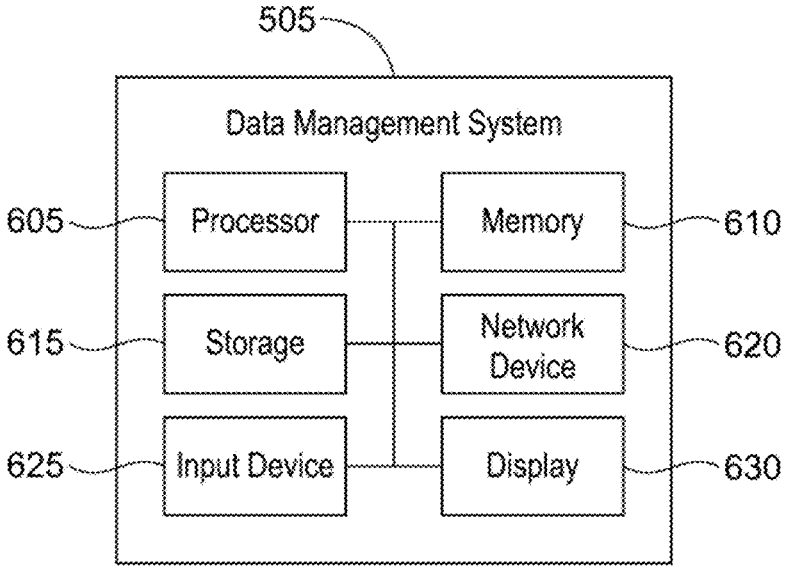
FIG. 6 is a diagram of a data management system used in the FIG. 5 system.
Figure 7:
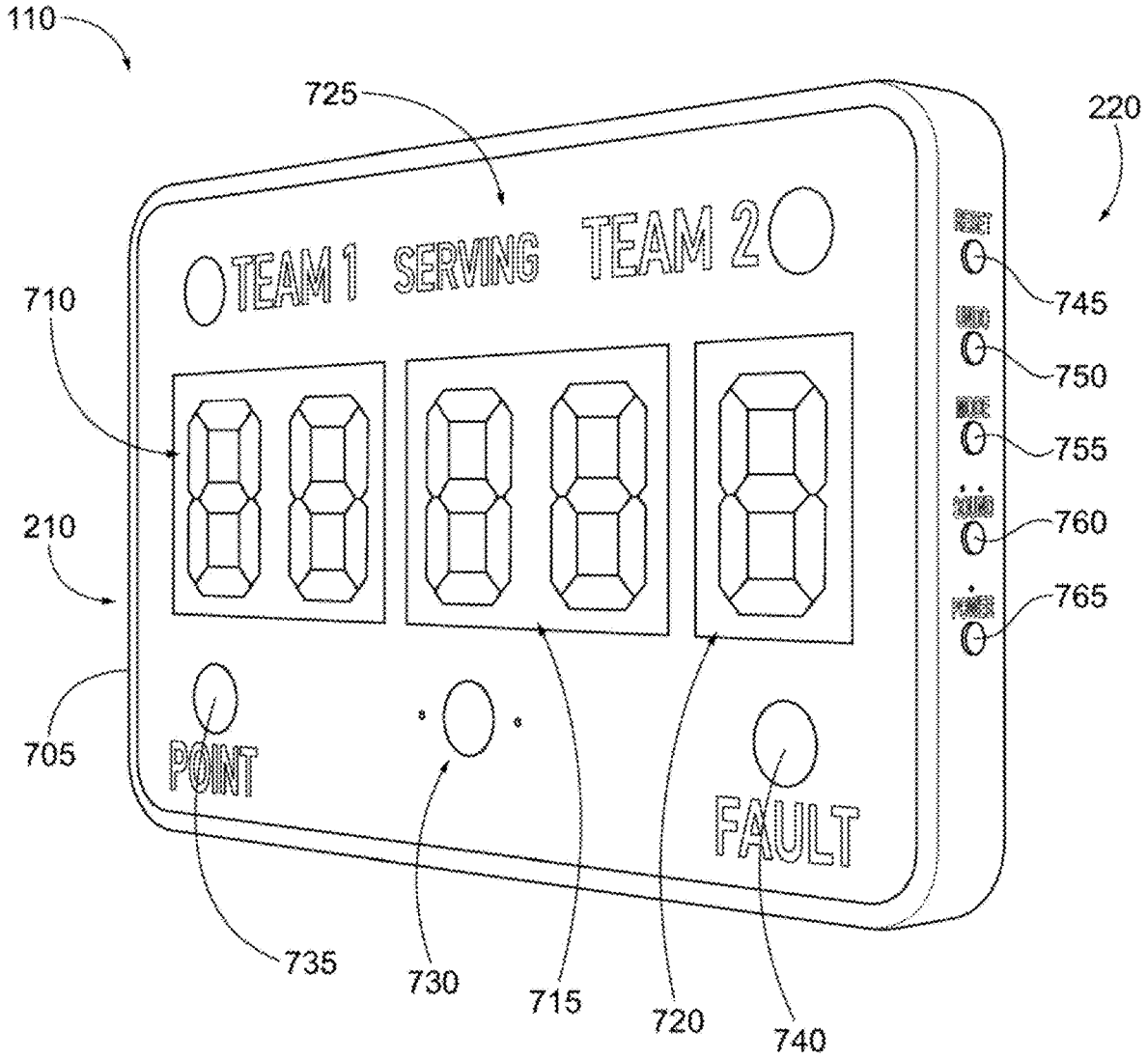
FIG. 7 is a front perspective view of the FIG. 2 scoreboard according to one example.
Figure 8:
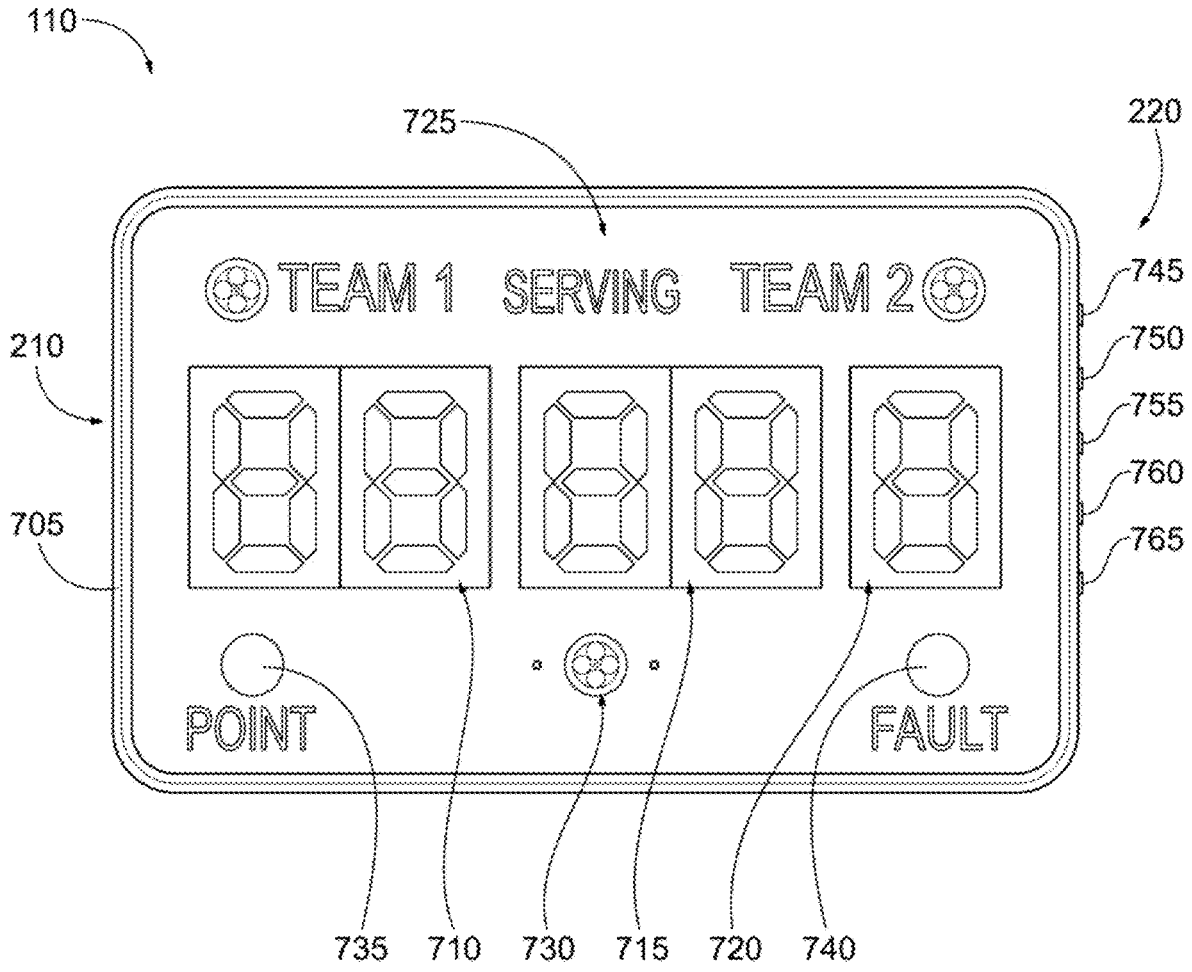
FIG. 8 is a front view of the FIG. 7 scoreboard.
Figure 9:
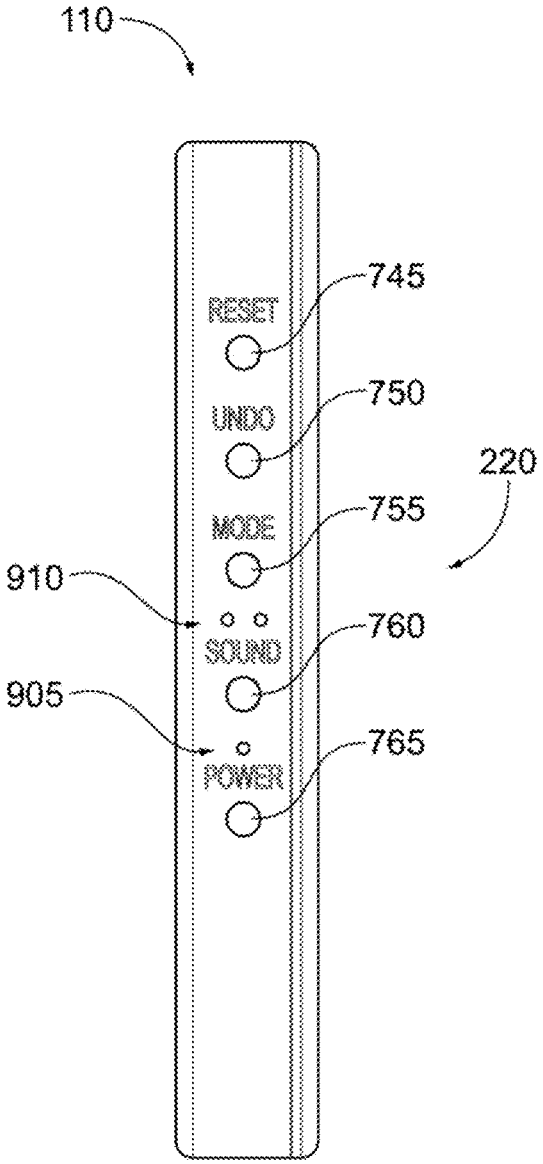
FIG. 9 is a first side view of the FIG. 7 scoreboard.

FIG. 6 illustrates the data management system 505 according to one version. The data management system 505 generally includes a processor 605, a memory 610, a storage device 615, and a networking device 620. The processor 605, the memory 610, the storage device 615, and the networking device 620 are communicatively connected and are configured to send data and other communications to one another. For example, the processor 605, the memory 610, the storage device 615, and the networking device 620 can be connected using one or more bus bars and/or other conductors.

The processor 605 is configured to perform calculations, execute algorithms, process information, and/or perform other computational tasks. In one version, the processor 605 is configured to perform one or more algorithms to determine player and/or team ranks and/or organize player and/or team matchups as some examples.

The memory 610 and storage device 615 are configured to store data, algorithms, and/or other information. As examples, the memory 610 and/or storage device 615 can store player and/or team identifiers, player and/or team statistics, game rules, scoring and/or ranking algorithms, tournament organization algorithms, game scheduling algorithms, and/or other types of information. The memory 610 generally stores information for a relatively short period of time, and generally stores information utilized by the processor 605. For example, the memory 610 stores algorithms and/or data as the processor 605 performs the algorithm and/or calculations on the data. The storage device 615 stores information for a longer period of time and generally stores a greater amount of information than the memory 610. For example, the storage device 615 can store large amounts of player and/or team statistics collected over time, game outcomes over time, information from other tournaments, and/or other information.

The networking device 620 is configured to connect the data management system 505 to other devices, such as the transceiver 215 on the scoreboard 110, the external display device 405, a network, and/or another device. In some examples, the networking device 620 is configured to connect to a Wi-Fi, Bluetooth®, cellular, and/or other type of network. In another example, the networking device 620 includes the same type of device as the transceiver 215 on the scoreboard 110 and/or the transceiver 315 on the fob 115. The networking device 620 allows the data management system 505 to communicate with the scoreboard 110 and/or other devices wirelessly, including sending and/or receiving data, alerts, updates, and/or other information. The networking device 620 is configured to support wired and/or wireless connections.

In one example, the data management system 505 further includes an input device 625 and/or a display 630. The input device 625 allows one of the users 120, an official, an event organizer, and/or others to provide inputs to the data management system 505. For example, the input device 625 allows event organizers to update information about the tournament organization, tournament scheduling, player statistics, game outcomes, tournament rules, and/or other details. The display 630 is configured to display scores, game outcomes, tournament seedings, the names of participating players and/or teams, the tournament scheduling, tournament organization, and/or other information. Alternatively or additionally, the data management system 505 displays such information on the external display device 405.

FIGS. 7, 8, 9, 10, and 11 illustrate the scoreboard 110 according to one version. The scoreboard 110 includes a housing 705 that generally encloses the internal components of the scoreboard 110, such as the controller 205, the input device 220, and/or the ESS 230. The housing 705 is typically made of a durable material. Using a durable housing 705 allows the scoreboard 110 to withstand incidental hits from players, the ball, paddles, and/or other game equipment. Further, the housing 705 is shaped to support the scoreboard 110 in an upright position. The housing 705 fully contains the scoreboard 110 and allows the scoreboard 110 to be easily repositioned around the field of play 105. For instance, when playing outside, direct sunlight hitting the scoreboard 110 often hinders the visibility of the display 210, such as through glares and/or flashes. The portability of the scoreboard 110 allows the user 120 to move the scoreboard 110 out of direct sunlight such that the display 210 is fully visible and easily readable.

In the illustrated example, the display 210 is separated into multiple sections and includes multiple forms of displays. As shown, the display 210 generally includes a first team score display 710, a second team score display 715, a server number display 720, and a serving team display 725. The first team score display 710 is configured to display the score of a first team. Similarly, the second team score display 715 is configured to display the score of a second team. In one example, the first team is the serving team 125 and the second team is the receiving team 130 at the start of the game. In another example, the scoreboard 110 is configured to change the position of the first team score display 710 and the second team score display 715 on the display 210 based on the position of the teams relative to the scoreboard 110. For instance, the scoreboard 110 is configured to flip the scores on the display 210 if the scoreboard 110 is moved from one side of the field of play 105 to the opposite side. The server number display 720 is configured to denote the player that is serving. For example, the server number display 720 displays "1" if the first server 135 is serving and "2" if the second server 140 is serving. The serving team display 725 denotes the team that is currently the serving team 125. In the illustrated example, the first team score display 710, the second team score display 715, and the server number display 720 are numeric light displays. Conversely, the serving team display 725 includes multiple LEDs or other types of lights that selectively illuminate to denote the serving team 125. For instance, the serving team display 725 includes one LED adjacent to a first team name and another LED adjacent to a second team name. As should be appreciated, the display 210 is able to utilize the first team score display 710, the second team score display 715, the server number display 720, and the serving team display 725 in a variety of forms, such as one or more display screens, LED arrangements, and/or other devices. Further, the scoreboard 110 generally allows display settings to be customized. In one example, the display settings are adjustable through an application on a user device, such as a smartphone and/or personal computer. For instance, the color of text and/or numbers, the color of sections of the display 210, the color of particular LEDs and/or LED arrangements, the brightness, and/or other settings are adjustable.

In one example, the display 210 further includes an activity indicator 730. The activity indicator 730 generally indicates when a point is scored, a fault is committed, and/or another game event occurs. In the illustrated example, the activity indicator 730 is one or more LEDs that illuminate and/or flash when a game event occurs. In one example, the scoreboard 110 is configured to activate the activity indicator 730 and the speaker 225 at the same time to indicate a game event has occurred. In another example, the activity indicator 730 is configured to illuminate in a color associated with a team or player that scores and/or has control of the serve. As should be appreciated, the scoreboard 110 is configured to indicate scoring, faults, and other game events in a variety of ways and/or using a variety of types of devices.

In the illustrated example, the input device 220 includes multiple buttons and/or switches. As shown, the input device 220 includes a first button 735, a second button 740, a reset button 745, a undo button 750, a mode button 755, a sound button 760, and a power button 765. In another example, one or more of the input devices 220, such as the first button 735 and the second button 740 for instance, are incorporated with the display 210 as a touchscreen. The first button 735 is generally used to indicate a rally result in favor of the serving team 125. The second button 740 is generally used to indicate a rally result in favor of the receiving team 130. The first button 735 and the second button 740 allow the scoreboard 110 be used without the fobs 115. In one example, the first button 735 and the second button 740 are positioned on the face of the scoreboard 110 to be easily accessible to the user 120.

The scoreboard 110 allows the first button 735 and the second button 740 to input rally results according to a variety of configurations. The scoreboard 110 allows the user 120 to adjust the input configuration of the first button 735 and the second button 740, such as through an application on a mobile device. In one version, the first button 735 and the second button 740 are configured as score and fault buttons respectively. In this version, the first button 735 is used to mark a point for the current serving team 125 and the second button 740 is used to mark a fault against the current serving team 125. In other words, the first button 735 and the second button 740 indicate points and faults with respect to the team that is currently serving. For example, the scoreboard 110 is configured to increase the score of the serving team 125 when the first button 735 is pressed. In that example, the scoreboard 110 is configured to switch the player or team that is serving and/to increase the score of the receiving team 130 when the second button 740 is pressed. For instance, using traditional scoring in pickleball, pressing the second button 740 switches the server. Using pickleball rally scoring in this configuration, pressing the second button 740 increases the score of the receiving team 130 in addition to changing the server. In some cases, this configuration of the first button 735 and the second button 740 is more intuitive for experienced pickleball players.

In another version, the first button 735 and the second button 740 are configured as first team and second team buttons respectively. In this version, the first button 735 is used to indicate a rally result in favor of the team that starts the game as the serving team 125. The second button 740 is used to indicate a rally result in favor of the team that starts the game as the receiving team 130. In other words, the first button 735 and the second button 740 each mark rally results for one team consistently throughout the game. For example, pressing the first button 735 increases the score of a first team when the first team is serving. Similarly, pressing the second button 740 increases the score of a second team when the second team is serving. Using pickleball rally scoring in this configuration, pressing the first button 735 increases the score of the first team and pressing the second button 740 increases the score of the second team regardless of the team that served. In some cases, this configuration of the first button 735 and the second button 740 is more intuitive to newer players.

The reset button 745 and the undo button 750 generally provide additional ways for the user 120 to adjust the score and/or the server. Pressing the reset button 745 causes the scoreboard 110 to reset the score and server to begin a new game. For example, the first team score display 710 and the second team score display 715 display "0" after the reset button 745 is pressed. Further, the server number display 720 displays "1" after the reset button 745 is pressed to indicate the first server 135 is up to serve. Pressing the undo button 750 causes the scoreboard 110 to reverse the previous input from the user 120. For instance, if the first button 735 was pressed and the score increased for the serving team 125, pressing the undo button 750 decreases the score to undo the change. As another example, if the second button 740 was pressed and the display 210 changed to show that the second server 140 was serving, pressing the undo button 750 changes the server back to the first server 135. Alternatively or additionally, pressing and holding the first button 735 and/or the second button 740 reverses the inputs in the same way as pressing the undo button 750.

The mode button 755 allows the user 120 to adjust various aspects about the game rules. The rules generally specify the number of players, when scoring occurs, how many points are needed to win, and the margin of points for a win (i.e., win by 2) among other details considered by the scoreboard 110. In one example, the mode button 755 allows the user 120 to change the number of players. In another example, the scoreboard 110 stores multiple sets of rules for pickleball. In that example, pressing the mode button 755 changes the ruleset being used. For instance, pressing the mode button 755 allows the user to select between traditional and rally scoring and/or whether to play to 11, 15, or 21. In yet another example, pressing the mode button 755 allows the user 120 to select rules for different games altogether, such as tennis, table tennis, and/or racquetball as some examples. As noted, in some examples, the rules and/or other settings are adjustable through an application on a personal device. As should be appreciated, the scoreboard 110 is configured to adjust the rules and/or other game information in other ways, such as through the data management system 505, the fob 115, and/or another device.

The sound button 760 allows the user 120 to adjust the operation of the input device 220 and/or another external speaker. In one example, pressing the sound button 760 toggles the audio on and off. In another example, pressing the sound button 760 incrementally adjusts the volume level. In yet another example, pressing the sound button 760 changes the type of audio coming from the input device 220, such as to selectively provide audio feedback upon user inputs and/or an audible announcement of the score before each serve. The power button 765 allows the user 120 to switch the scoreboard 110 on and off. In one example, the scoreboard 110 is configured to load all previously used settings upon powering on. For instance, all changes to the game mode and/or audio settings are maintained when the user 120 powers off the scoreboard 110. Therefore the user 120 only needs to adjust the settings as desired when initially using the scoreboard 110. This allows the user 120 to focus on playing the game rather than performing repetitive setup tasks.

In the illustrated example, the scoreboard 110 further includes a power indicator 905 and a sound indicator 910. The power indicator 905 is typically an LED or other light emitting element that indicates that the scoreboard 110 is powered on. For example, the power indicator 905 is configured to illuminate and/or flash when the power button 765 is pressed and the scoreboard 110 begins operating. In another example, the power indicator 905 is configured to blink when a charge level of the ESS 230 drops below a certain level. The sound indicator 910 is typically an arrangement of LEDs or other lights that indicate information about the sound from the input device 220. In one example, the brightness of the lights change and/or certain lights illuminate when the sound button 760 is pressed. As should be appreciated, the scoreboard 110 is configured to indicate information about the sound, power, and/or other operating characteristics of the scoreboard 110 using the display 210 and/or another device. Additionally or alternatively, the scoreboard 110 is configured to provide audio feedback through the speaker 225 based on the power indicator 905, the sound indicator 910, and/or another button being pressed.

In one version, the face of the scoreboard 110 is 7 inches tall and 11 inches wide. In one example, the display 210 extends across all or nearly all of the face of the scoreboard 110. In another example, the first team score display 710, the second team score display 715, and the server number display 720 are at least 2 inches tall, up to 3 inches tall, greater than 3 inches tall and/or another size. Displaying numbers at that size on the first team score display 710, the second team score display 715, and/or the server number display 720 generally ensures that the numbers will be legible to the users 120. Further, the first team score display 710, the second team score display 715, and the server number display 720 are generally centered along the vertical height of the scoreboard 110. As should be appreciated, the size of the scoreboard 110 can vary. In other examples, the scoreboard 110 is up to 5 inches tall, up to 10 inches tall, up to 15 inches tall, and/or greater than 15 inches tall. Further, the scoreboard 110 is up to 8 inches wide, up to 16 inches wide, up to 24 inches wide, and/or greater than 24 inches wide.

Figure 10:
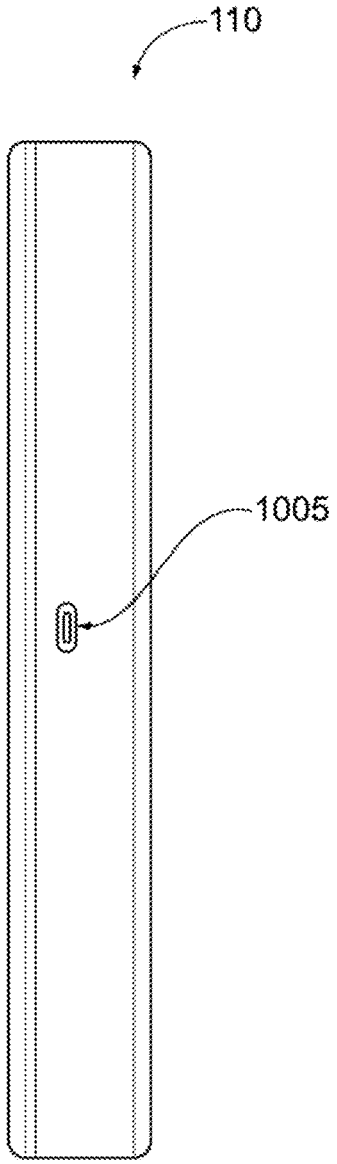
FIG. 10 is a second side view of the FIG. 7 scoreboard.

As shown in FIG. 10, the scoreboard 110 further includes a port 1005. The port 1005 is socket configured to receive power to charge the ESS 230. In one example, the port 1005 is a USB-C, micro-USB, and/or other type of port. Alternatively or additionally, the port 1005 supports data transfer over a wired connection, such as through a USB and/or an HDMI cable. For instance, the port 1005 allows the scoreboard 110 to connect to the external display device 405 through a wired connection.

Figure 11:
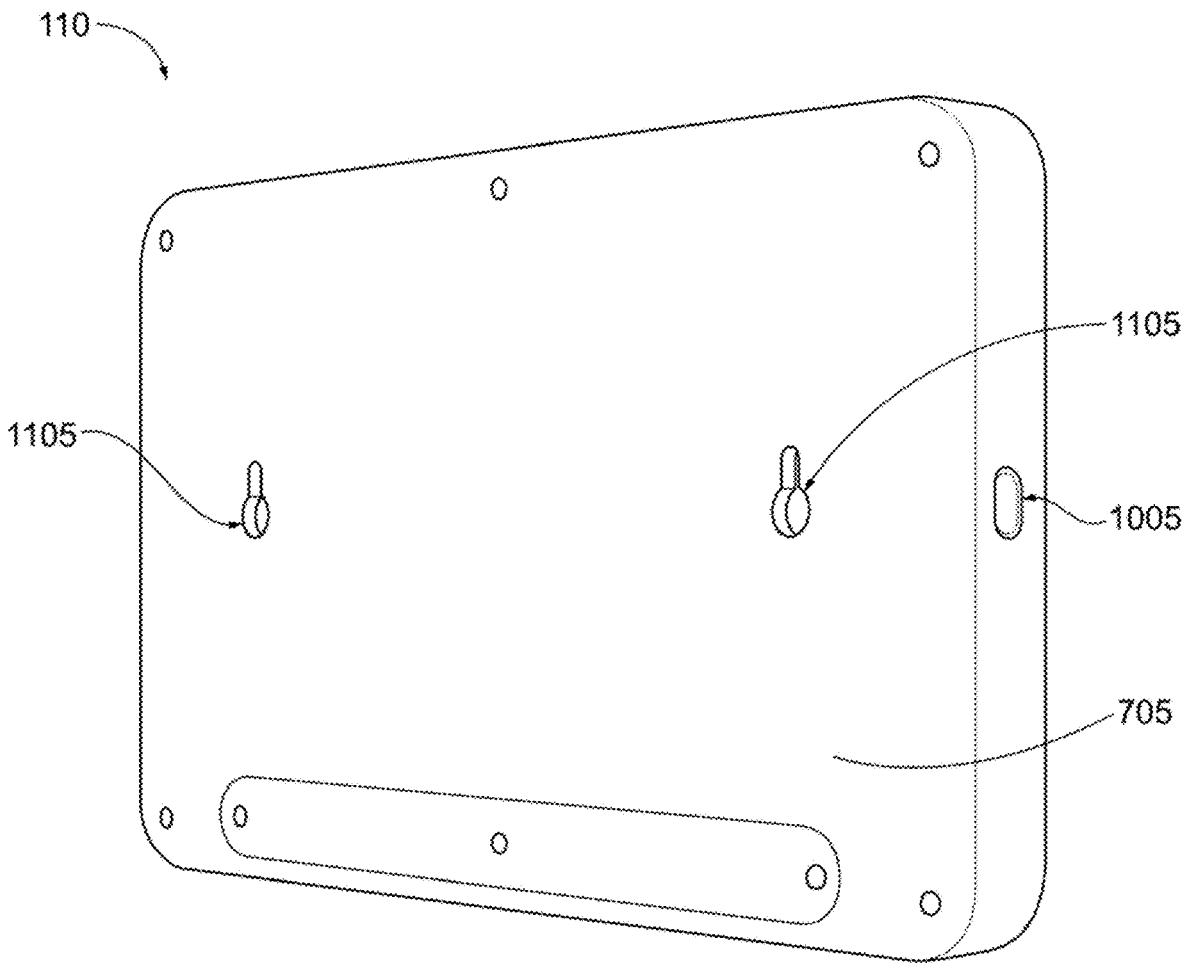
FIG. 11 is a rear perspective view of the FIG. 7 scoreboard.

As shown in FIG. 11, the housing 705 defines one or more mounting holes 1105. The mounting holes 1105 provide a space for the housing 705 to receive a hook, pin, nail, and/or other structure for mounting the scoreboard 110. The mounting holes 1105 generally allow the scoreboard 110 to be mounted on a wall, fence, and/or other structure near the field of play 105. Mounting the scoreboard 110 ensures that the display 210 is in view of the users 120 and that the scoreboard 110 remains in place during play. In another example, the scoreboard 110 is configured to mount to a structure in another way, such as through fasteners and/or hooks on the scoreboard 110. In yet another example, the scoreboard 110 is configured to mount to a tripod or another type of stand to allow the scoreboard 110 to be positioned anywhere around the field of play 105 at a raised height.

In one version, the scoreboard 110 includes a personal computing device, such as a smartphone, a tablet, a laptop, and/or other type of personal computer. For example, the personal computing device includes an application and/or other software that is configured to receive user inputs and track the score. The personal computing device is generally configured to connect to the fobs 115 through Bluetooth®, Wi-Fi, and/or another type of wireless connection. Using the personal computing device as the scoreboard 110 allows the users 120 to utilize existing equipment with the fobs 115 to keep score.

Figure 12:
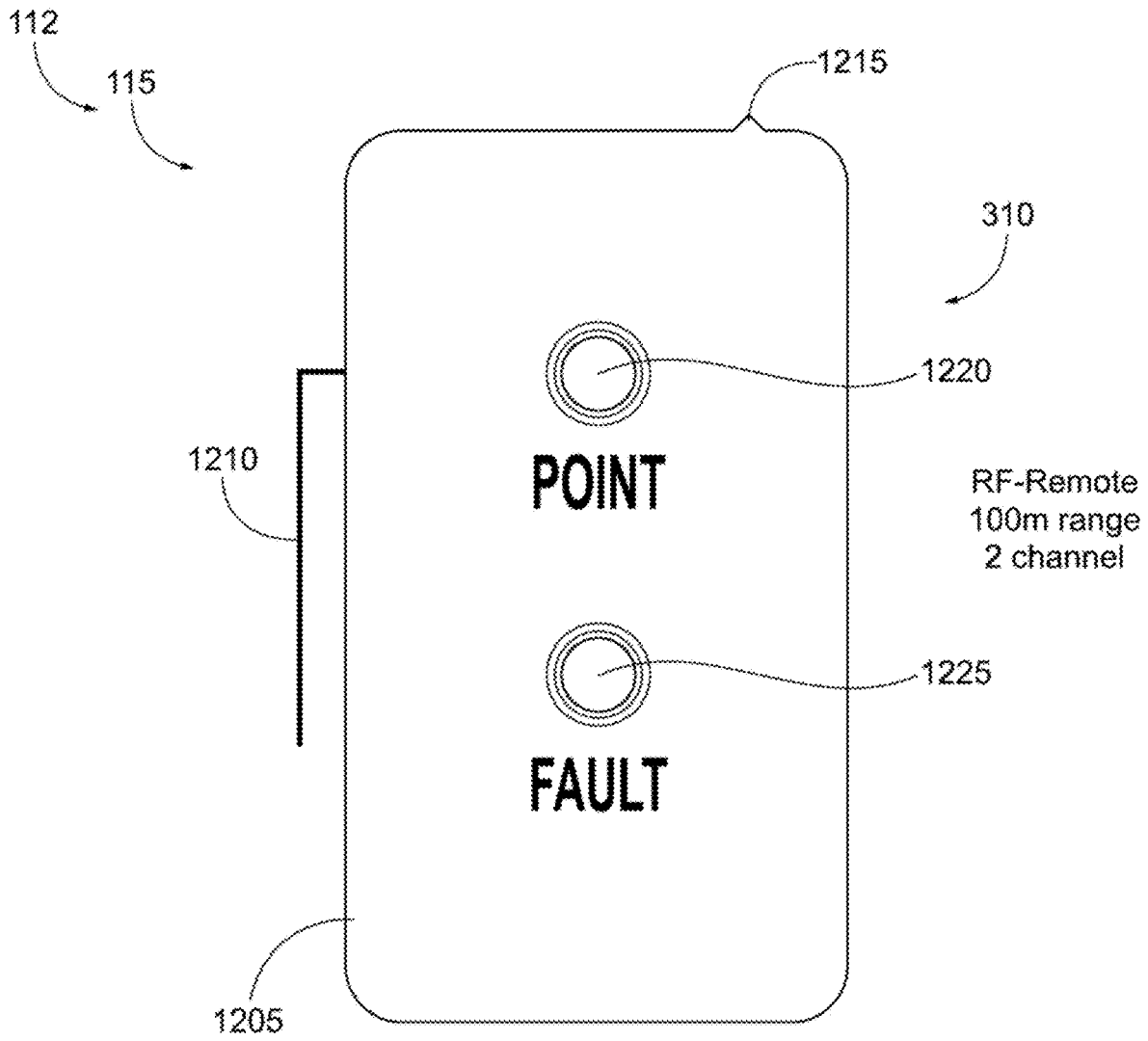
FIG. 12 is a front view of the FIG. 3 fob according to one example.

FIG. 12 illustrates the fob 115 according to one example. The fob 115 includes a housing 1205 that encloses the internal components of the fob 115, such as the controller 305 and the ESS 320. The housing 1205 is typically made of a durable material. Further, the housing 1205 has a compact shape such that the fob 115 is minimally intrusive on the user 120. For instance, the small size of the fob 115 allows the user 120 to place the fob 115 in a pocket. In another example, the fob 115 is configured to attach to and/or embed into a paddle used by the user 120. In the illustrated example, the fob 115 further includes a clip 1210 and an antenna 1215. The clip 1210 is configured to secure the fob 115 to the user 120, such as on a skirt, pants, shirt, and/or hat. In another example, the fob 115 includes a strap that attaches the fob 115 to the wrist or arm of the user 120. As should be appreciated, the fob 115 alternatively or additionally includes other ways to keep the fob 115 on the player, such as a lanyard, a keychain, and/or a carabiner as some examples. The antenna 1215 is configured to transmit and receive wireless signals. The antenna 1215 is connected to or a part of the transceiver 315.

As shown, the input device 310 on the fob 115 includes a first button 1220 and a second button 1225. The first button 1220 is generally configured to function the same way as the first button 735 on the scoreboard 110. The second button 1225 is generally configured to function the same way as the second button 740 on the scoreboard 110. For example, the scoreboard 110 is configured to adjust the score and/or the server in the same way when receiving inputs via the first button 1220 and the second button 1225 on the fob 115 as when receiving inputs via the first button 735 and second button 740 on the scoreboard 110. In another example, holding the first button 1220 sends a reset input to the scoreboard 110 that causes the game to reset, such as in the same way as pressing the reset button 745. In that example, holding the second button 1225 sends an undo input to the scoreboard 110 that reverses the last received input, such as in the same way as pressing the undo button 750. As noted, the scoreboard 110 allows the user 120 to adjust the settings for inputs, such as inputs from the first button 1220 and the second button 1225. For instance, the configuration of the first button 1220 and the second button 1225 is adjustable through an application on a mobile device that connects to the scoreboard 110. As should be appreciated, the fob 115 is configured to receive a variety of inputs through any number of buttons, switches, and/or other input devices 310.

According to one example, the scoreboard 110 generally displays "0-0-1" across the first team score display 710, the second team score display 715, and the server number display 720 when the scoreboard 110 powers on. In other words, the score for the serving team 125 is 0, the score for the receiving team 130 is 0, and the first server 135 is serving. In the following example course of play, the scoreboard 110 is arranged for four users 120 playing doubles. Further, in the following example, the first button 1220 and the second button 1225 are configured as point and fault buttons with respect to the current server. At the start, the first server 135 faults on the serve. The first server 135 then presses the second button 1225 to change the display 210 to show "0-0-2." In other words, the server number display 720 shows that the second server 140 is now serving. The first team scores on that rally. The second server 140 then presses the first button 1220 to change the display 210 to show "1-0-2." In some examples, the speaker 225 announces the score and the server by saying those three numbers. For instance, before the serve, the speaker 225 announces "1-0-2". The second server 140 on the first team serves again but the first team loses the rally. The second server 140 then presses the second button 1225 to change the display 210 to show "0-1-1." The serve switches and the second team becomes the serving team 125. The display 210 shows that the serving team 125 has 0 points, the receiving team 130 has 1 point, and the first server 135 on the second team is now serving. On the next serve, the second team loses the rally. The first server 135 presses the second button 1225 and the display 210 changes to show "0-1-2." The second server 140 on the second team then serves. The second team wins the rally and the second server 140 presses the first button 1220. The display 210 then changes to show "1-1-2." The second server 140 serves again, scores another point, and presses the first button 1220 again. The display 210 then shows "2-1-2."

In the example play sequence, the scoreboard 110 is configured to always display the score of the serving team 125 on the first team score display 710 and the score of the receiving team 130 on the second team score display 715. The score of a given team therefore switches from between the first team score display 710 and the second team score display 715 depending on the team that is serving. In some cases, displaying the score in this way helps the users 120 keep track of the score and serve. In an alternate example, the scoreboard 110 displays the score of the first team on the first team score display 710 and the score of the second team on the second team score display 715 regardless of which team is the serving team 125. In any case, the scoreboard 110 is configured to display an identifier and/or use a color associated with each team and/or player to further clarify the score and the serve.

Further, in the example play sequence, each user 120 has a fob 115. Typically, the scoreboard 110 is configured to process inputs from only one fob 115 at a time. In that example, the scoreboard 110 switches control between the fobs 115 based on the player that is serving. For example, the same player on the serving team 125 or the serving player on the serving team 125 has control of the scoreboard 110 via the fob 115 at a given time. In another example, each team has one fob 115. In that case, the fob 115 held by a player on the serving team 125 has control of the scoreboard 110. In yet another example, there is only one fob 115. For instance, one player, a game official, and/or another neutral party has control of the scoreboard 110 via the fob 115 at all times. Alternatively or additionally, the scoreboard 110 is controllable through the input devices 220 on the scoreboard 110.

Figure 13:
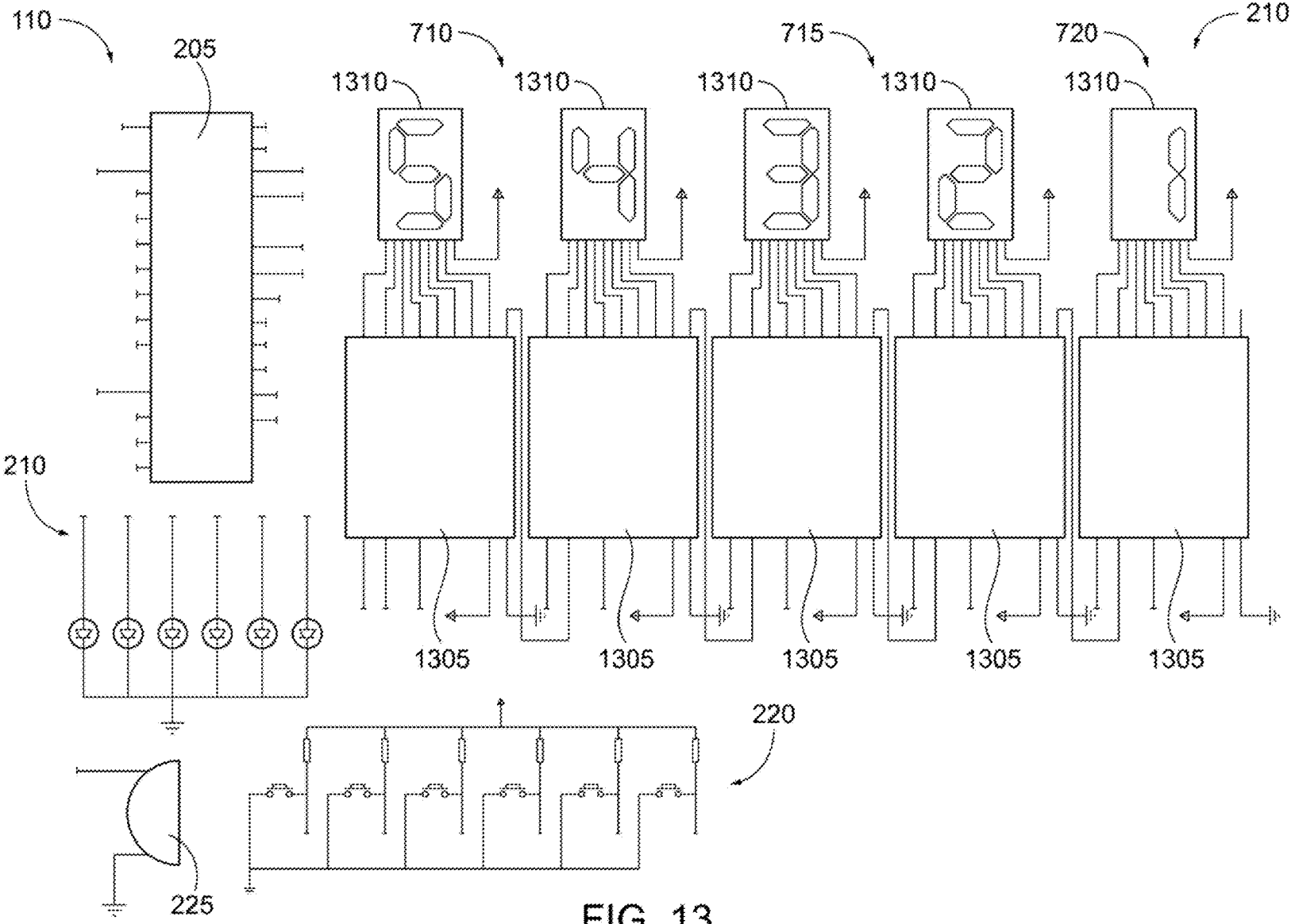
FIG. 13 is a schematic of the FIG. 7 scoreboard.
Figure 14:
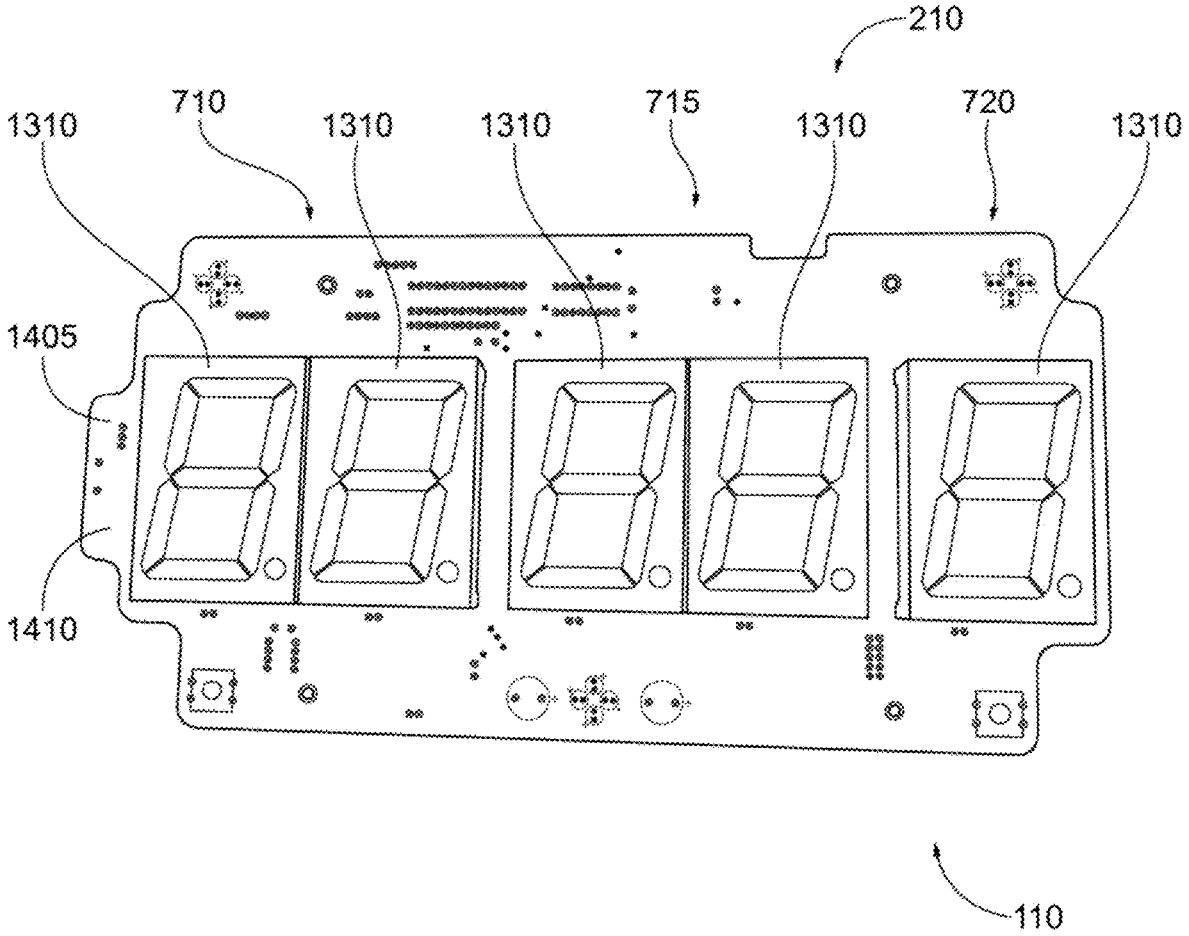
FIG. 14 is a front view of a circuit board used in the FIG. 7 scoreboard.
Figure 15:
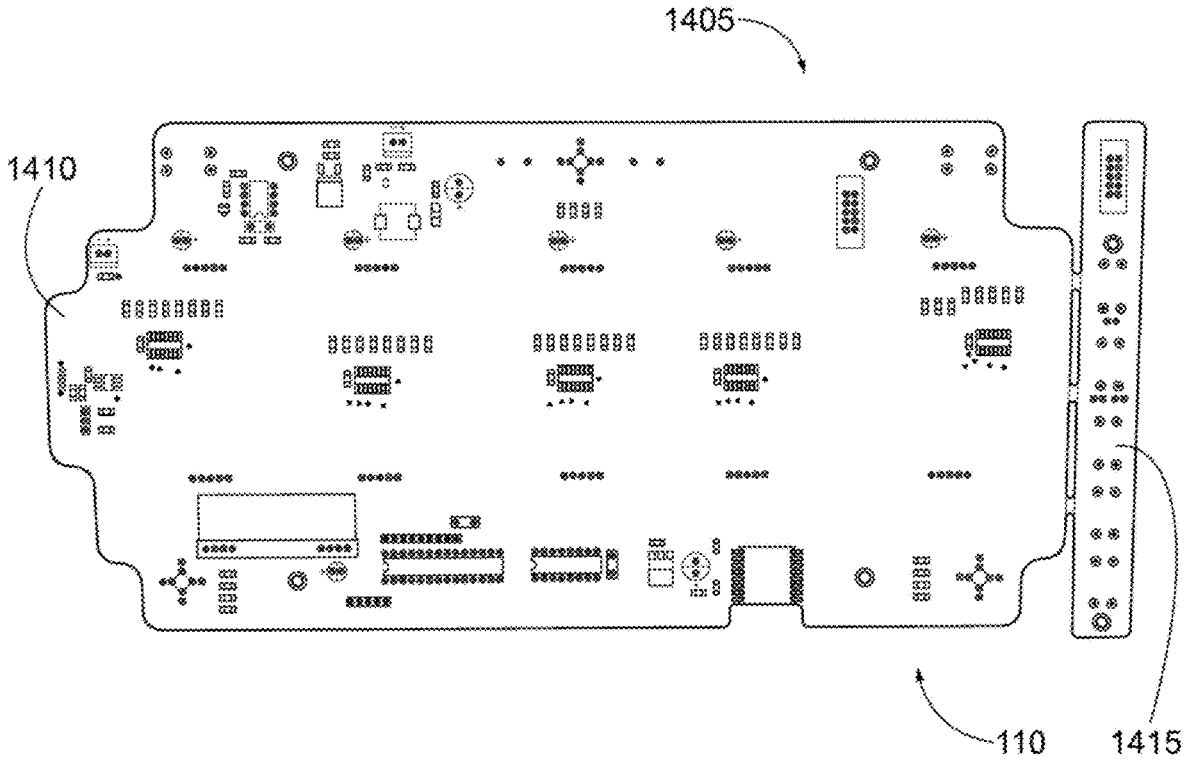
FIG. 15 is a rear view of the FIG. 14 circuit board.

Referring to FIGS. 13, 14, and 15, various internal components of the scoreboard 110 are illustrated according to one example. FIG. 13 shows a schematic of the scoreboard 110 including the controller 205, the displays 210, the input devices 220, and the speaker 225. As shown, the controller 205 generally has input channels connected to each of the input devices 220. Further, the controller 205 generally has output channels connected to the displays 210 and the speaker 225. In the illustrated example, the scoreboard 110 further includes one or more display drivers 1305. The display drivers 1305 are connected between the controller 205 and parts of the display 210. The display driver 1305 is configured to process a signal from the controller 205 and to control part of the display 210 in response. The display driver 1305 is typically configured to operate a specific type of display 210, such as a particular type of display screen and/or LED arrangement. Using the display drivers 1305 allows the controller 205 to control various types of displays 210.

In the illustrated examples, the display 210 includes multiple 7-segment displays 1310. The 7-segment displays 1310 are arrangements of LEDs and/or other light emitting devices. Each 7-segment display 1310 is typically configured to display a number or letter by turning on select LEDs in the arrangement. As shown, the first team score display 710, the second team score display 715, and the server number display 720 each include a 7-segment display 1310. Because the first team score display 710, the second team score display 715, and the server number display 720 generally only display numbers, the 7-segment displays 1310 provide a simple way to display the necessary information. In an alternate example, the first team score display 710, the second team score display 715, and/or the server number display 720 are part of a screen and/or LED panel that allows more details to be displayed beyond simple numbers and/or letters.

FIGS. 14 and 15 illustrate a circuit board 1405 used by the scoreboard 110. The circuit board 1405 generally provides electrical connections between the components of the scoreboard 110. Further, the circuit board 1405 provides some structural support and fixes components in place within the housing 705. In the illustrated example, the circuit board 1405 includes a first board 1410 and a second board 1415. The first board 1410 generally provides space to connect the display 210. For example, the 7-segment displays 1310 of the first team score display 710, the second team score display 715, and the server number display 720 are mounted to the first board 1410. In one example, the controller 205 is further attached to the first board 1410. The second board 1415 generally provides space to connect one or more input devices 220. In one example, the reset button 745, the undo button 750, the mode button 755, the sound button 760, and the power button 765 are attached to the second board 1415. Using the first board 1410 and the second board 1415 allows different components to be positioned at different locations on the scoreboard 110. For example, the display 210 on the first board 1410 is positioned on a front face of the scoreboard 110 and the input devices 220 on the second board 1415 are positioned on a lateral side of the scoreboard 110. As should be appreciated, the scoreboard 110 is configured to utilize components electrically connected in a variety of ways and/or arranged on any number of boards.

Figure 16:
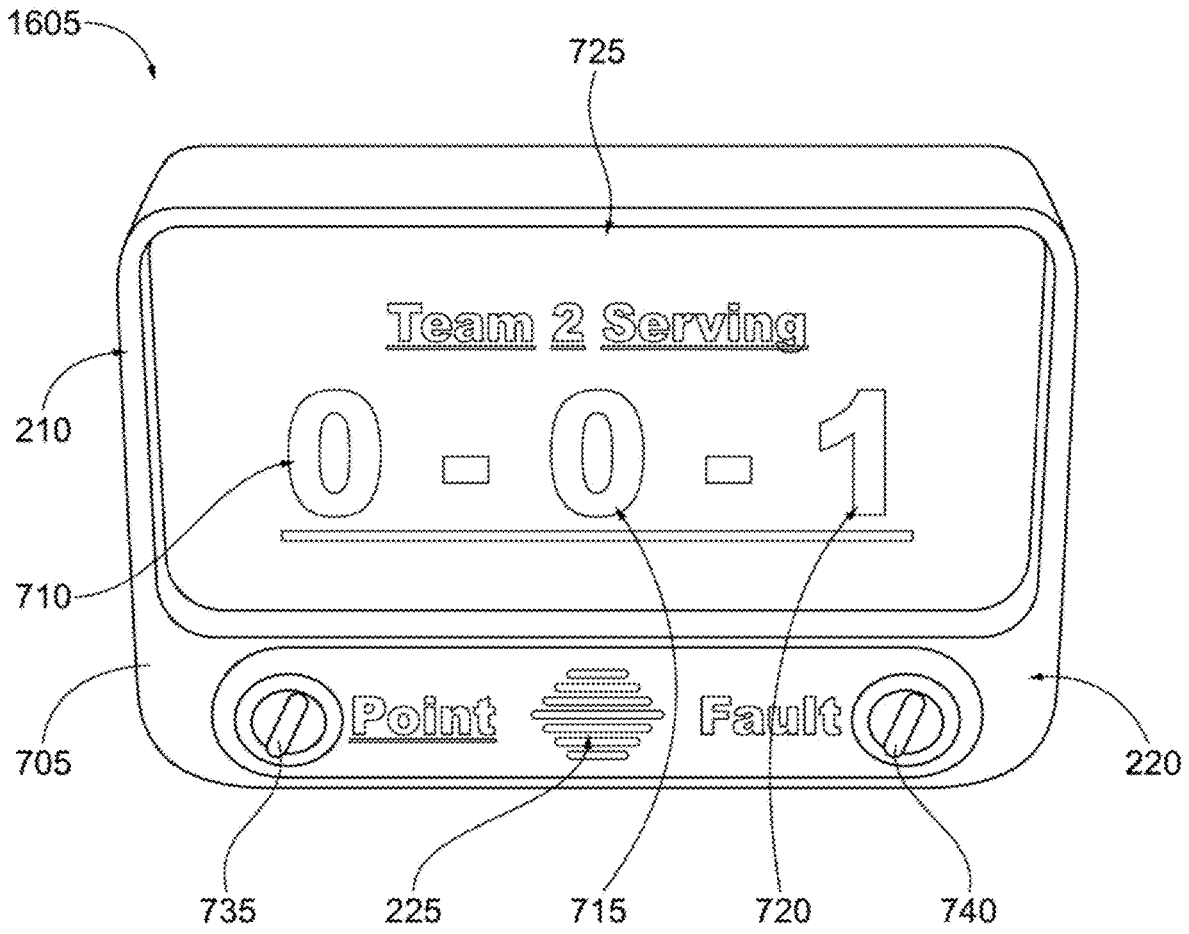
FIG. 16 is a front view of the FIG. 2 scoreboard according to an alternate example.
Figure 17:
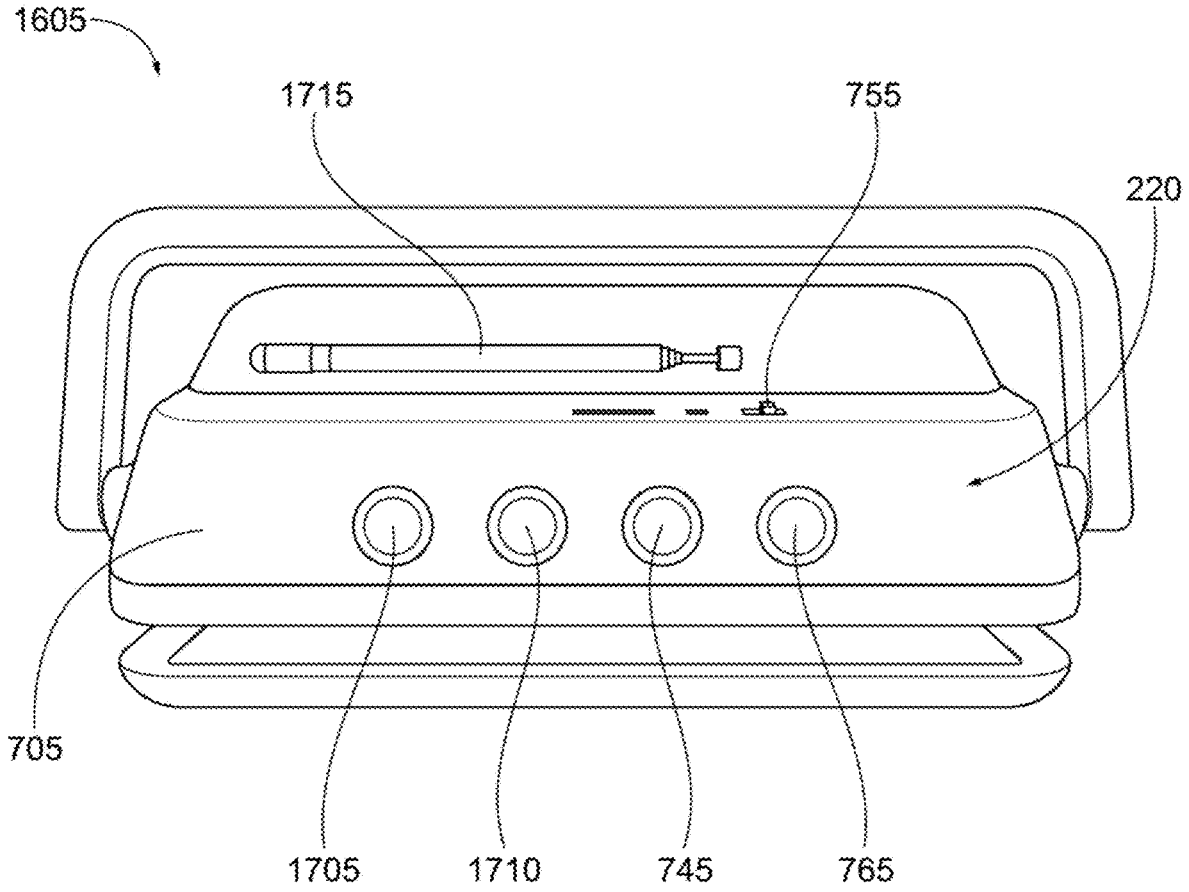
FIG. 17 is a top view of the FIG. 16 scoreboard.

Referring to FIGS. 16, 17, 18, 19, and 20, the scoreboard 110 is illustrated according to additional examples. FIGS. 16 and 17 illustrate a scoreboard 1605, another example of the scoreboard 110. The scoreboard 1605 generally includes the same components as the scoreboard 110, such as the display 210, the input device 220, and/or the speaker 225 among other examples. In some examples, the scoreboard 1605 includes one or more parts not in the scoreboard 110 and/or omits one or more parts from the scoreboard 110. Further, in some examples, one or more parts in the scoreboard 1605 are different from corresponding parts in the scoreboard 110. For instance, the housing 705 in the scoreboard 1605 is generally a different shape and size than the housing 705 in the scoreboard 110 shown in FIG. 7. In the FIGS. 16 and 17 example, the display 210 on the scoreboard 1605 is a continuous screen that integrates the first team score display 710, the second team score display 715, the server number display 720, and the serving team display 725. As shown, the scoreboard 1605 includes the first button 735, the second button 740, the reset button 745, the mode button 755, and the power button 765. The scoreboard 1605 further includes an end match button 1705 and a custom button 1710. The end match button 1705 allows the user 120 to end the game. In one example, pressing the end match button 1705 prompts the scoreboard 110 to send scores and/or other information from the game to the data management system 505, such as to confirm the completion of a tournament matchup. The custom button 1710 is generally allows the user 120 to provide a customized input. In one example, the custom button 1710 allows the user 120 to change game settings on the scoreboard 110. For instance, the custom button 1710 allows the user 120 to change the scoring method, the number of points to win, and/or other conditions. In another example, the scoreboard 110 allows such settings and/or the function of the custom button 1710 to be customized through an application on a mobile device. In one example, the end match button 1705, the custom button 1710, and the reset button 745 are push buttons, the mode button 755 is a slider switch, and the power button 765 is a push switch. In the illustrated example, the scoreboard 1605 further includes an antenna 1715. The antenna 1715 generally allows the scoreboard 110 to communicate wirelessly with the fob 115, the data management system 505, and/or other devices. In one example, the antenna 1715 is connected to or a part of the transceiver 215.

Figure 18:
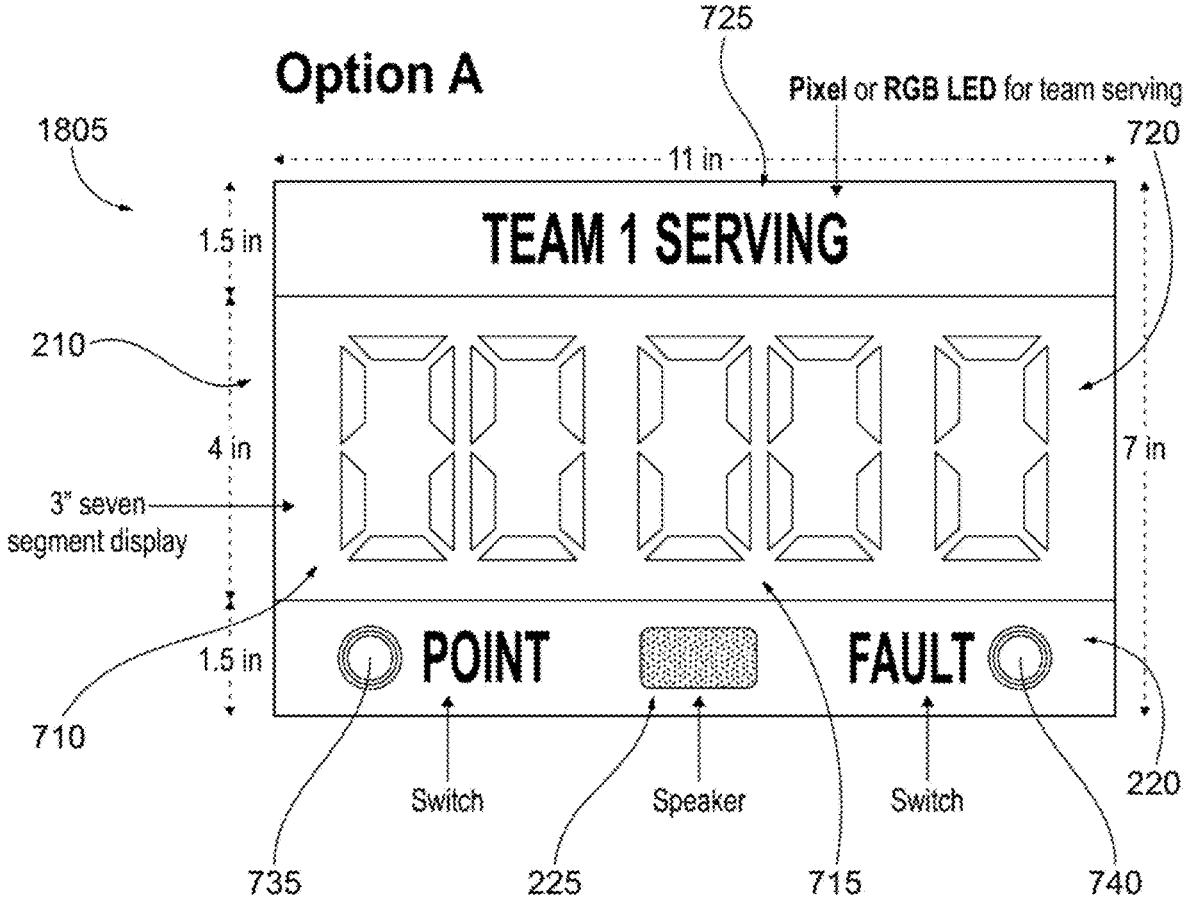
FIG. 18 is a front view of the FIG. 2 scoreboard according to another alternate example.
Figure 19:
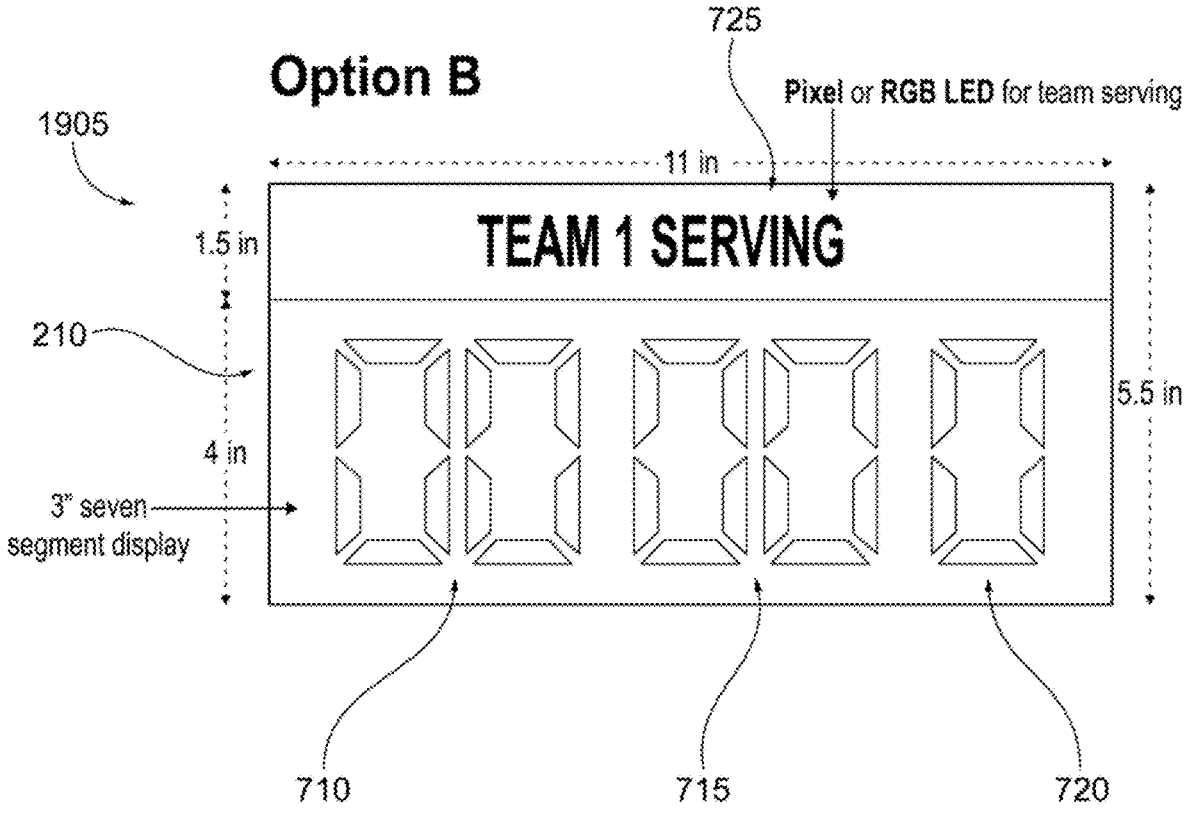
FIG. 19 is a front view of the FIG. 2 scoreboard according to yet another example.
Figure 20:
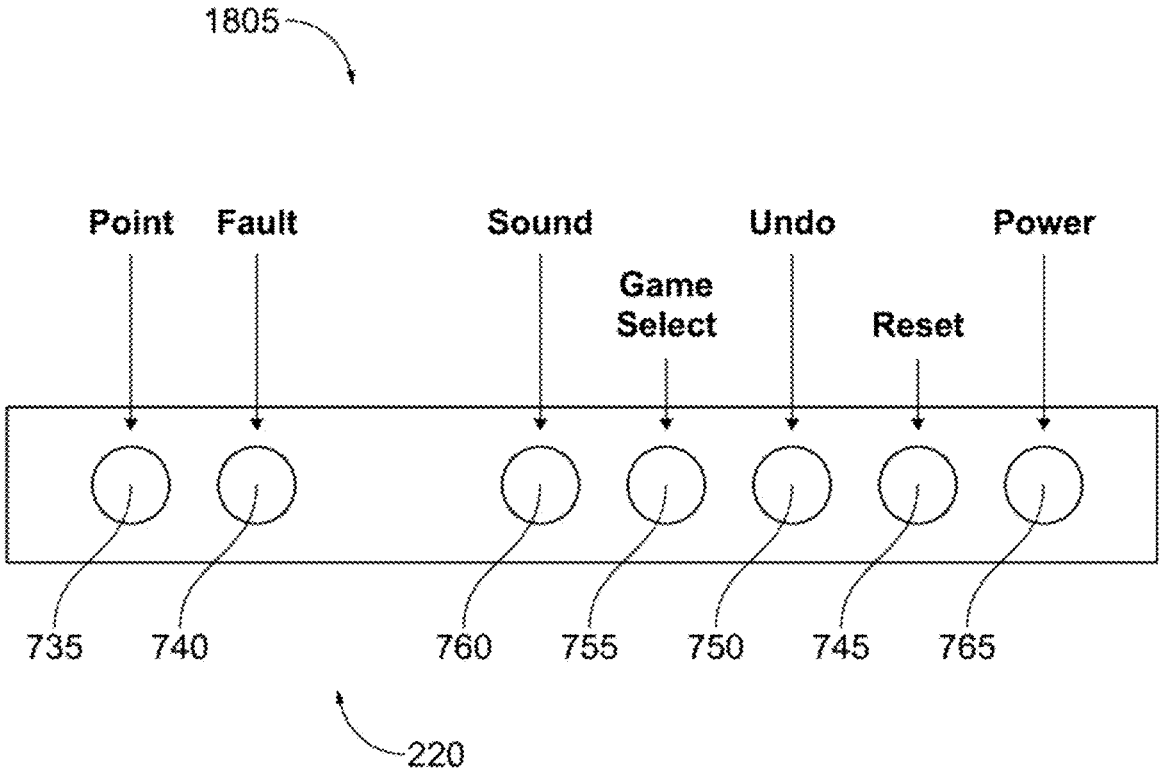
FIG. 20 is a top view of the FIG. 18 scoreboard.

FIGS. 18, 19, and 20 illustrate a scoreboard 1805 and a scoreboard 1905, additional examples of the scoreboard 110. The scoreboard 1805 and the scoreboard 1905 generally include the same components as the scoreboard 110 shown in previous figures, such as the display 210, the input device 220, and/or the speaker 225 among other examples. In some examples, the scoreboard 1805 and/or the scoreboard 1905 include one or more parts not in the scoreboard 110, omit one or more parts from the scoreboard 110, and/or include a part in a different form than in the scoreboard 110. In one example, the display 210 on the scoreboard 1805 is a continuous screen that shows scores, the player serving, and the team serving.

Referring to FIG. 20, one or more input devices 220 are positioned on a top side of the scoreboard 1805. The scoreboard 1805 generally includes the first button 735, the second button 740, the reset button 745, the undo button 750, the mode button 755, the sound button 760, and the power button 765 on the top side. In one example, the scoreboard 1905 utilizes the same arrangement of input devices 220 as the scoreboard 1805. In one example, the first button 735, the second button 740, the reset button 745, and the undo button 750 are push buttons, the mode button 755 is a slider switch, and the sound button 760 and the power button 765 are push switches. As should be appreciated, the scoreboard 110 shown in FIG. 1 is configured to incorporate any combination of features from the scoreboard 110 shown in FIG. 7, the scoreboard 1605 shown in FIGS. 16 and 17, the scoreboard 1805 shown in FIGS. 18 and 20, and/or the scoreboard 1905 shown in FIG. 19.

Figure 21:
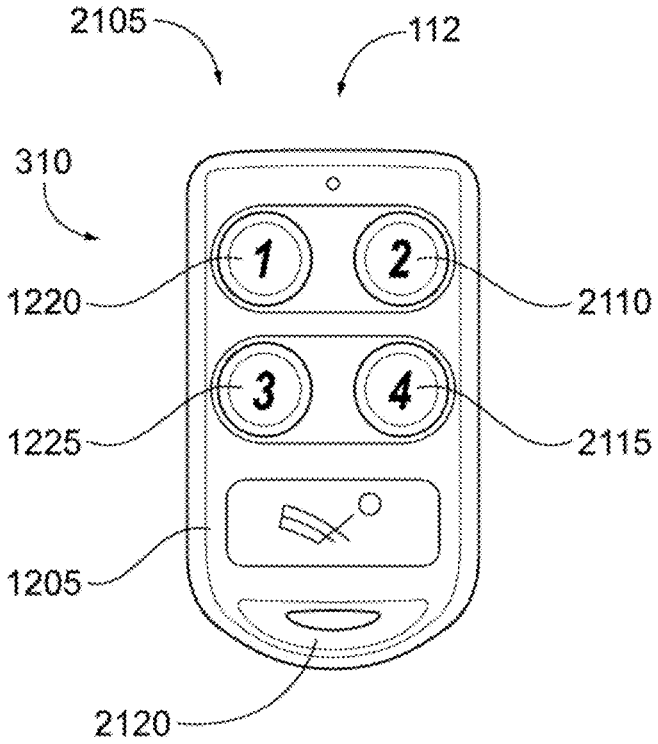
FIG. 21 is a perspective view of the FIG. 3 fob according to an alternate example.
Figure 22:
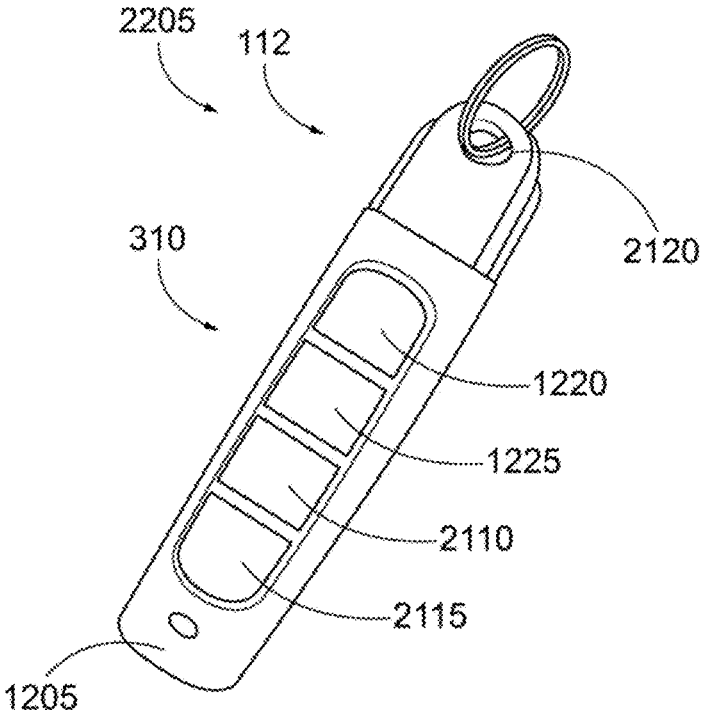
FIG. 22 is a perspective view of the FIG. 3 fob according to another alternate example.

FIGS. 21 and 22 illustrate a fob 2105 and a fob 2205, additional examples of the fob 115. The fob 2105 and the fob 2205 generally include additional input devices 310 compared to the fob 115 shown in FIG. 12. As shown, the fob 2105 and the fob 2205 each include a power button 2110 and a undo button 2115. The power button 2110 generally allows the user 120 to turn the scoreboard 110 on and off remotely. The undo button 2115 generally allows the user 120 to reverse the previous input. The power button 2110 generally functions the same as the power button 765 on the scoreboard 110 and the undo button 2115 generally functions the same as the undo button 750 on the scoreboard 110. As should be appreciated, the fob 2105 and the fob 2205 are configured to utilize any arrangement of input devices 310. Further, the fob 2105 includes a fob loop 2120. The fob loop 2120 allows the user 120 to attach a lanyard, strap, chain, string, and/or ring to the fob 2105 to keep the fob 2105 on the user 120. The fob 2205 similarly includes the fob loop 2120. As should be appreciated, the fob 115 shown in FIG. 1 is configured to incorporate any combination of features from the fob 115 shown in FIG. 12, the fob 2105 shown in FIG. 21, and/or the fob 2205 shown in FIG. 22.

Figure 23:
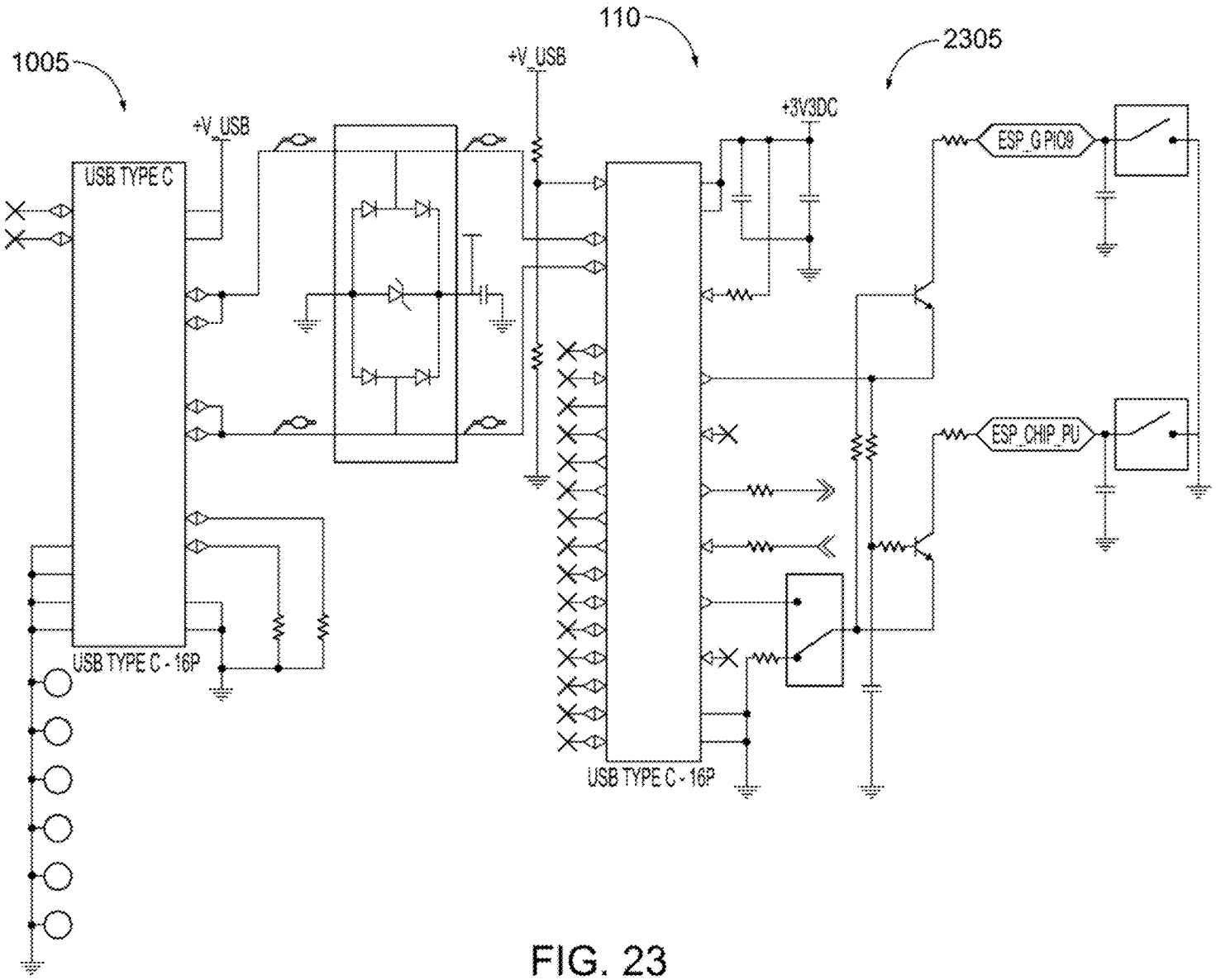
FIG. 23 is a schematic of a portion of the FIG. 7 scoreboard.
Figure 24:
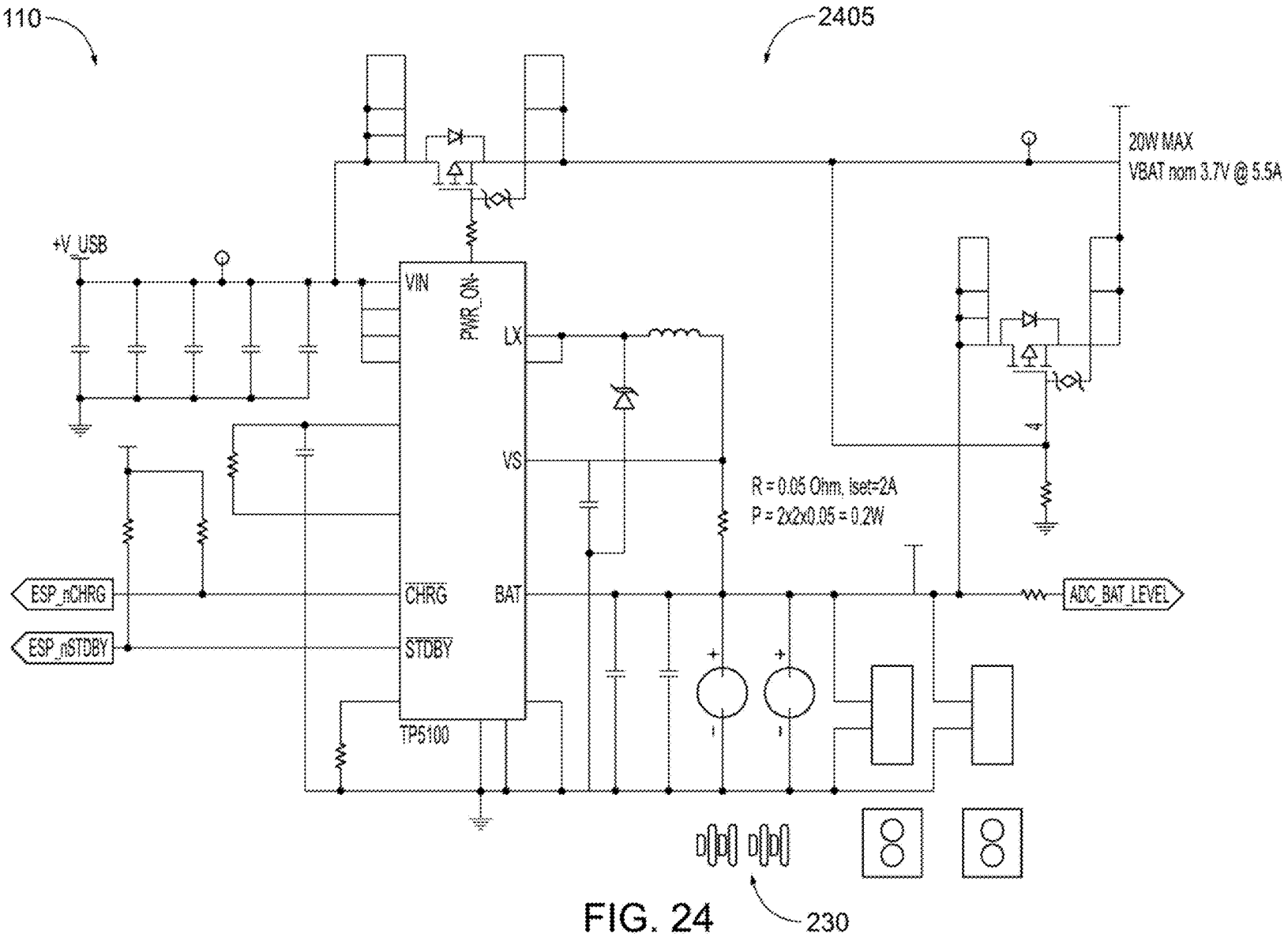
FIG. 24 is a schematic of another portion of the FIG. 7 scoreboard.
Figure 25:
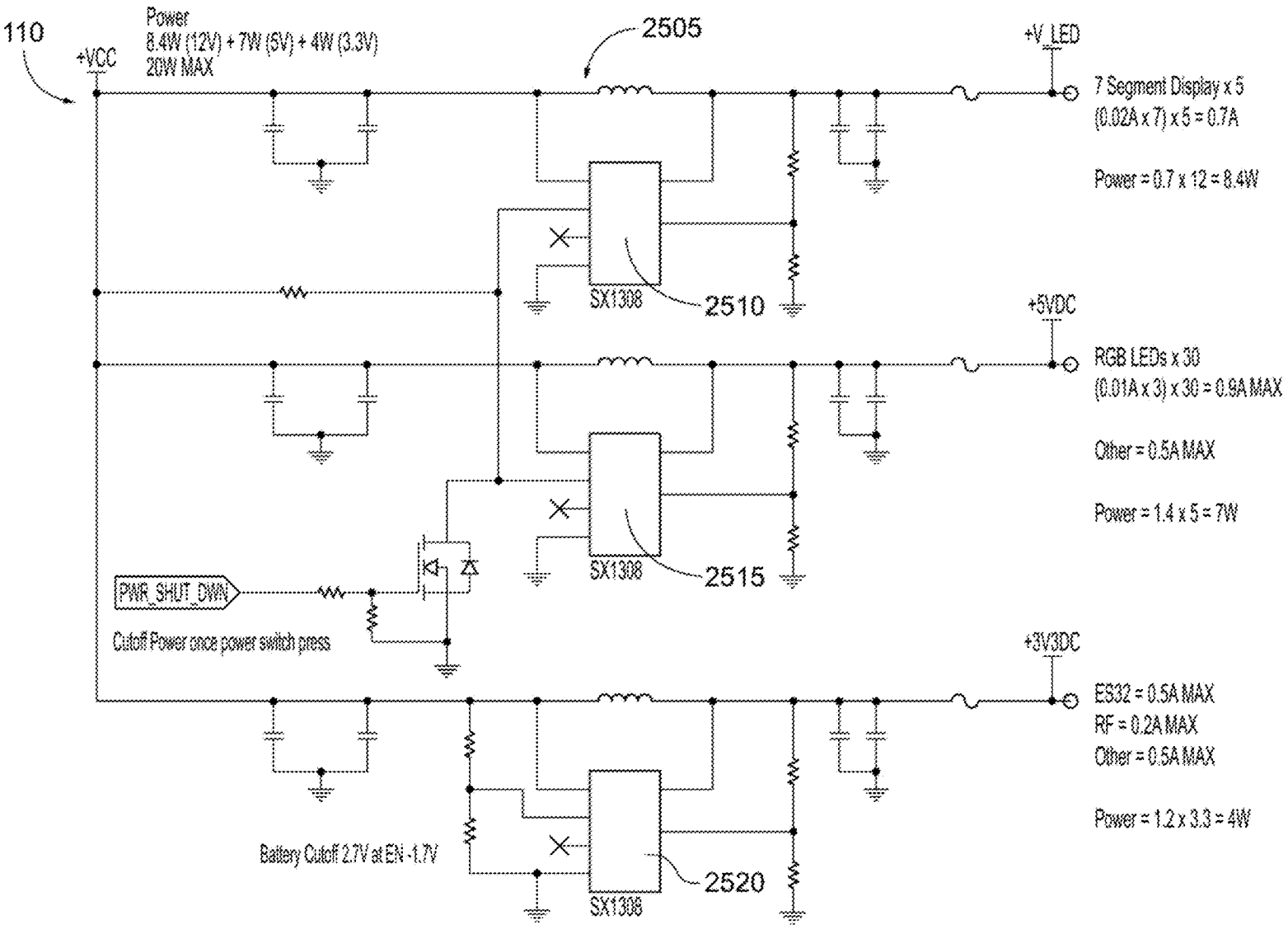
FIG. 25 is a schematic of yet another portion of the FIG. 7 scoreboard.

FIGS. 23, 24, and 25 illustrate schematics for various portions of the scoreboard 110 according to one example. The schematics shown in FIGS. 23, 24, and 25 generally illustrate additional parts of the scoreboard 110 that connect to the components shown in FIG. 13. As shown, the scoreboard 110 further includes a USB interface 2305. The USB interface 2305 generally connects the port 1005 to the controller 205 and/or other parts of the scoreboard 110. In one example, the USB interface 2305 is configured to convert signals received through the port 1005 into signals that are readable by the controller 205. As noted, the port 1005 is generally configured to receive a cable and electrically connect the scoreboard 110 to the cable. For example, the port 1005 allows the scoreboard 110 to connect to an external device through the cable. In the illustrated example, the port 1005 is a USB port. As should be appreciated, the scoreboard 110 is configured to utilize a variety of types of ports in addition or in place of the port 1005.

As shown in FIG. 24, the scoreboard 110 further includes a charge control circuit 2405. The charge control circuit 2405 is configured to control the flow of power to the ESS 230 during charging. For example, the charge control circuit 2405 is configured to stop sending power to the ESS 230 if the charge level of the ESS 230 is full. The charge control circuit 2405 electrically connects the ESS 230 to the port 1005 and/or another port to receive power. In one example, the charge control circuit 2405 further controls the discharge of power from the ESS 230, such as limiting the power sent to the controller 205 and/or other parts of the scoreboard 110.

Referring to FIG. 25, the scoreboard 110 typically includes one or more power converters 2505. The power converter 2505 is configured to electrical convert power from the ESS 230 into a different form to meet the requirements of one or more components on the scoreboard 110. In the illustrated example, the power converter 2505 includes a first voltage converter 2510, a second voltage converter 2515, and a third voltage converter 2520. The first voltage converter 2510 is connected to the display drivers 1305 and/or the 7-segment displays 1310 shown in FIG. 13. Alternatively or additionally, the first voltage converter 2510 is connected to one or more other parts of the display 210. In one example, the first voltage converter 2510 is configured to supply power to the connected components at a voltage 12 volts DC. The second voltage converter 2515 is connected to one or more LEDs in the scoreboard 110, such as the serving team display 725, the activity indicator 730, the power indicator 905, the sound indicator 910, and/or other parts of the display 210. In one example, the second voltage converter 2515 is configured to supply power to the connected components at a voltage of 5 volts DC. The third voltage converter 2520 is connected to the controller 205. In one example, the third voltage converter 2520 is configured to supply power to the controller 205 at a voltage of 3.3 volts DC. As should be appreciated, the scoreboard 110 is configured to utilize any arrangement of power converters 2505 to route power to components in the scoreboard 110.

Figure 26:
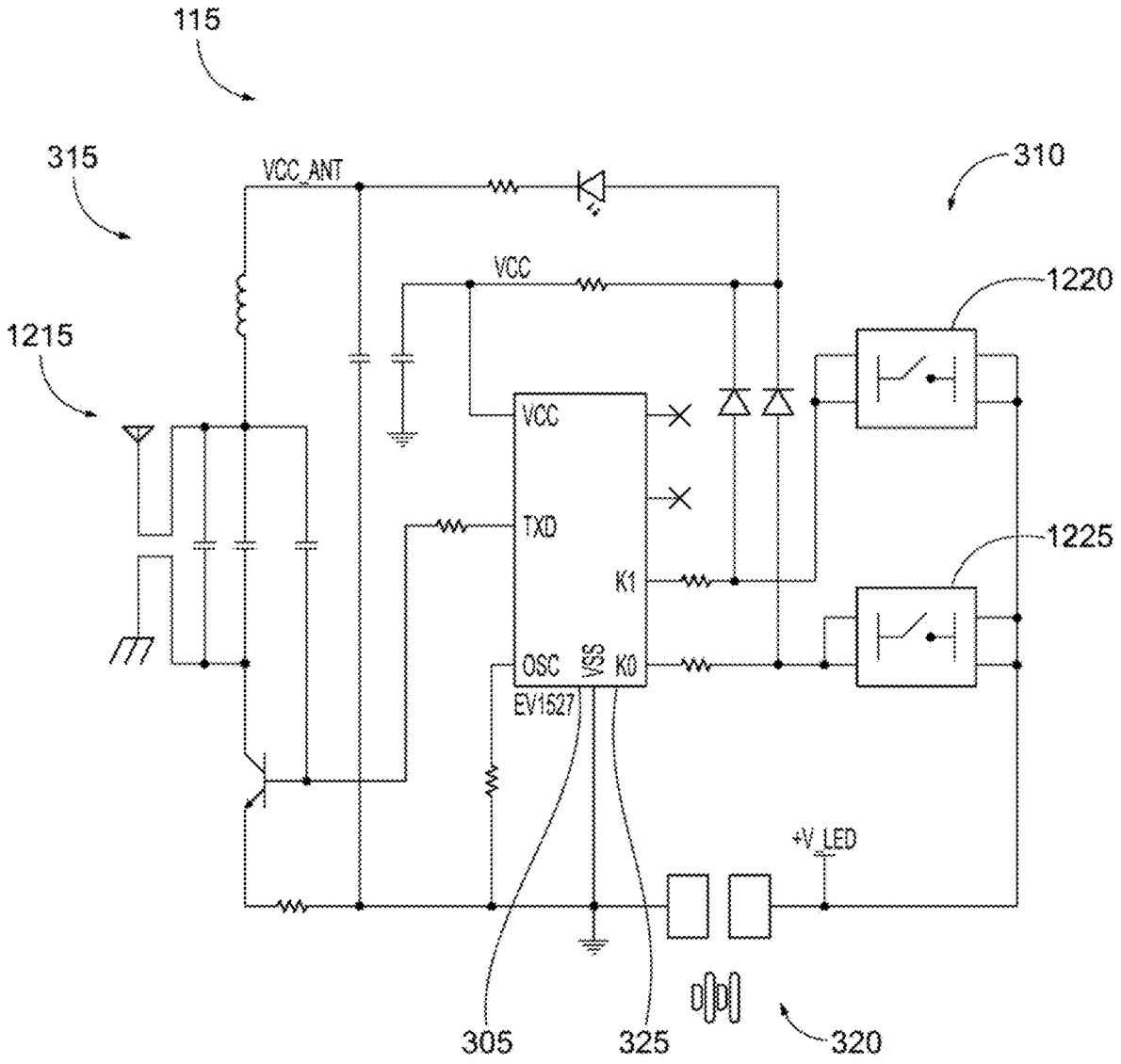
FIG. 26 is a schematic of the FIG. 12 fob.

FIG. 26 illustrates a schematic of the fob 115 according to one example. As shown, the controller 305 includes the integrated circuit 325. In one example, the integrated circuit 325 includes an encoder chip. The controller 305 is electrically connected to the input device 310, the transceiver 315, and the ESS 320. In the illustrated example, the first button 1220 and the second button 1225 are physical switches that are connected to the controller 305 and the ESS 320. Further, the transceiver 315 includes the antenna 1215 and additional circuitry. For example, the transceiver 315 includes an amplifier connected to the antenna 1215. In another example, the transceiver 315 includes one or more Ics, such as an amplifier IC, RF transmitter IC, and/or another type of IC.

Figure 27:
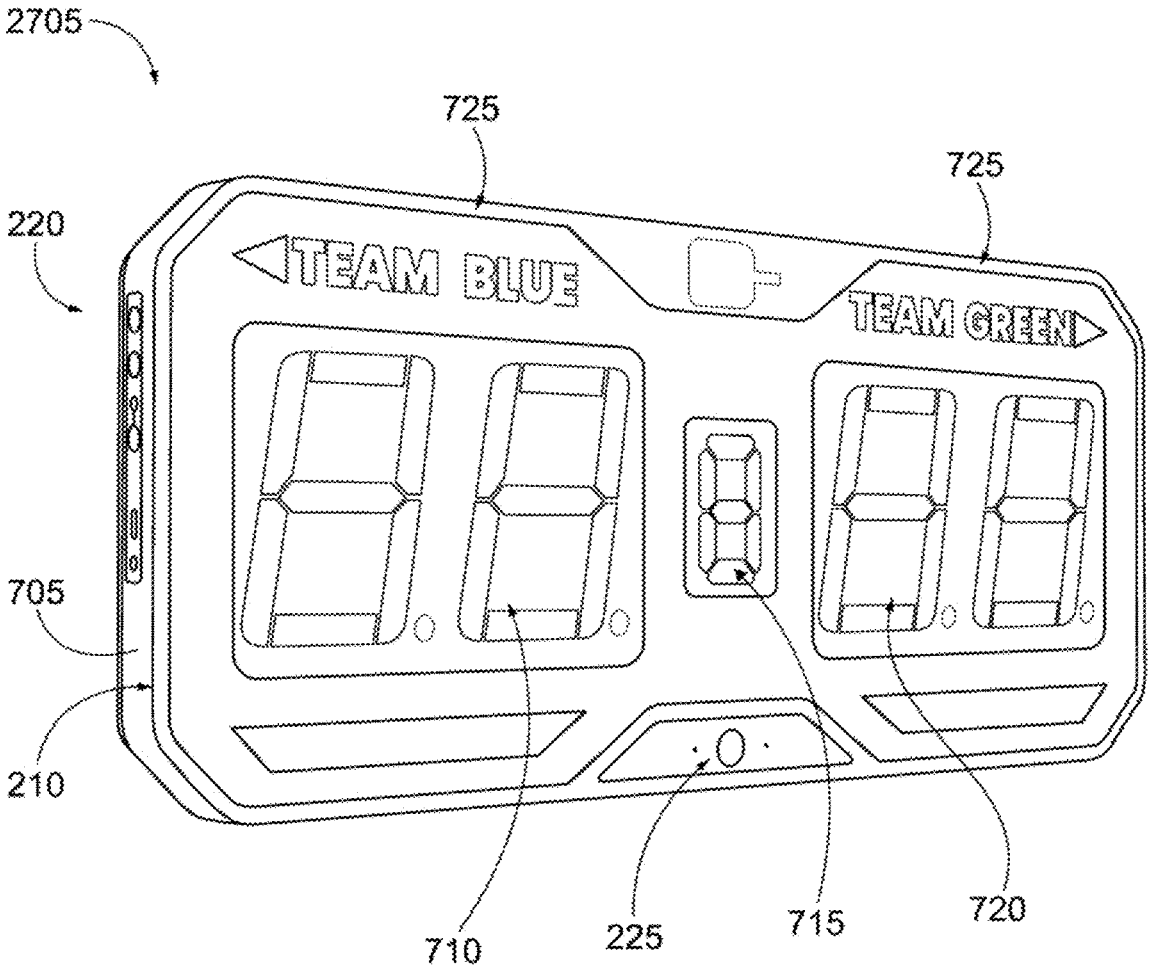
FIG. 27 is a front perspective view of the FIG. 2 scoreboard according to yet another example.
Figure 28:
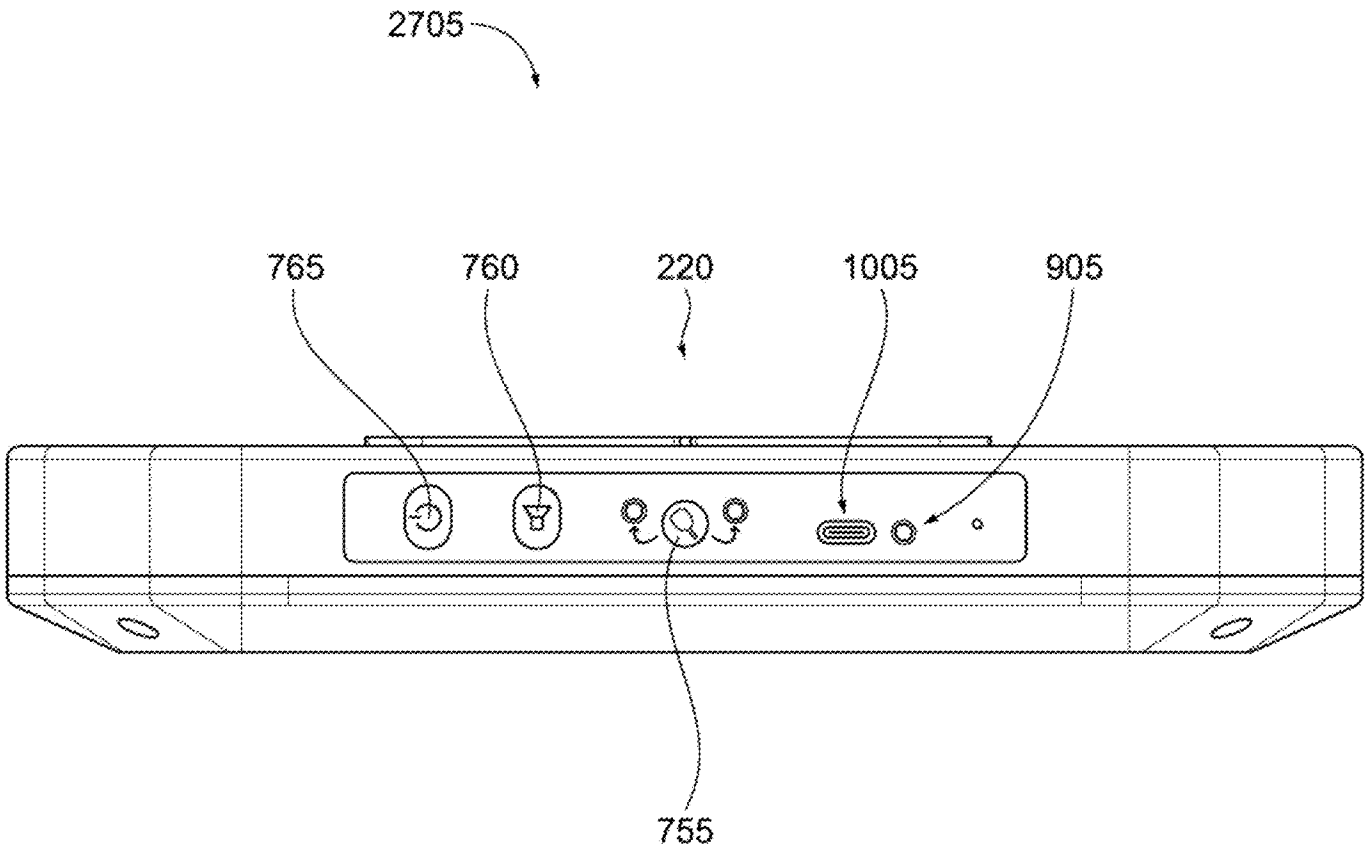
FIG. 28 is a side view of the FIG. 27 scoreboard.
Figure 29:
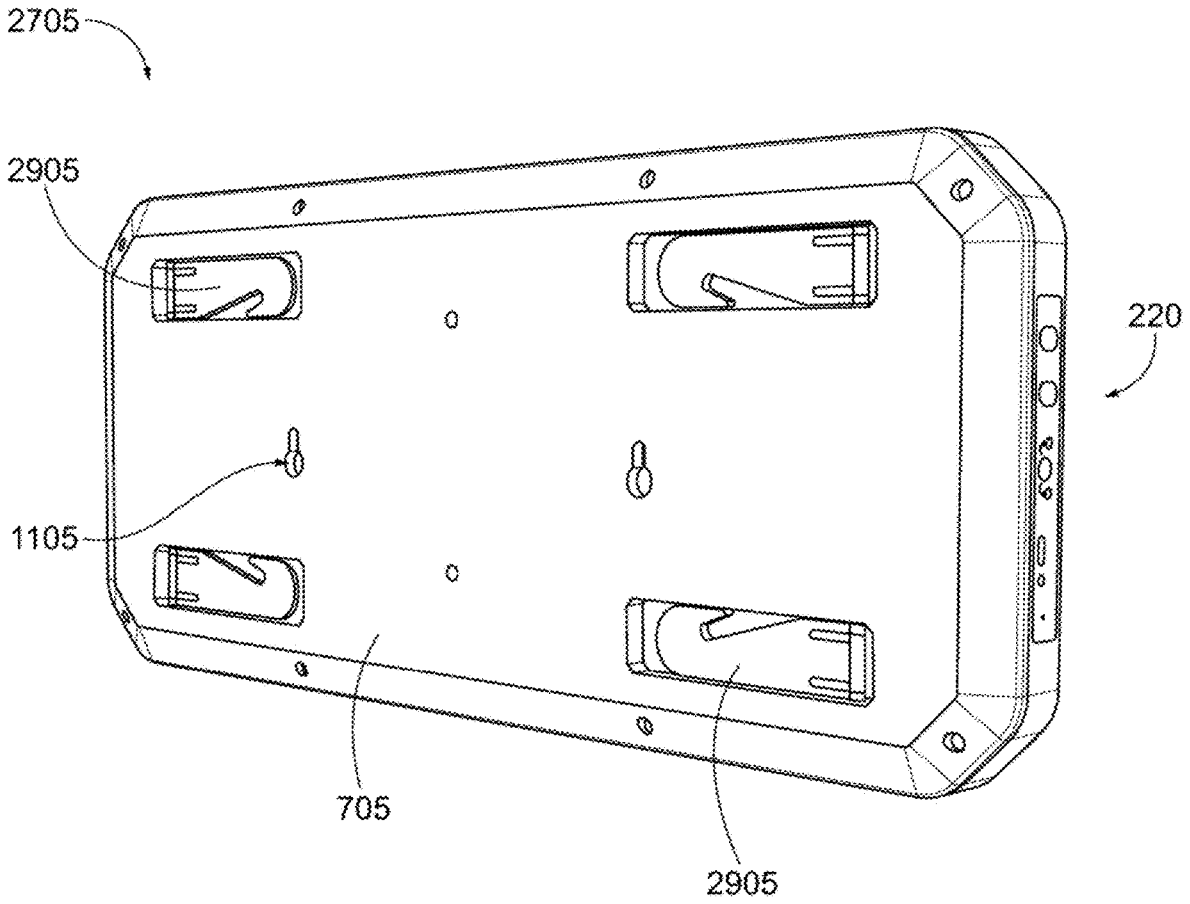
FIG. 29 is a rear perspective view of the FIG. 27 scoreboard.

Referring to FIGS. 27, 28, and 29, a scoreboard 2705 is another example of the scoreboard 110 shown in FIG. 2. The scoreboard 2705 generally includes the same components as the scoreboard 110 shown in previous figures, such as the display 210, the input device 220, and/or the speaker 225 among other examples. In some examples, the scoreboard 2705 includes one or more parts not in the scoreboard 110, omits one or more parts from the scoreboard 110, and/or includes a part in a different form than in the scoreboard 110. In the illustrated example, the scoreboard 2705 includes the housing 705, the first team score display 710, the second team score display 715, the server number display 720, the serving team display 725, the mode button 755, the sound button 760, the power button 765, the power indicator 905, the port 1005, and the mounting hole 1105 as shown in FIGS. 7-11. In one example, the mode button 755 allows the user 120 to select the team and/or player that serves first. As should be appreciated, the scoreboard 110 is configured to utilize any combination of features of the scoreboard 110 shown in FIG. 7, the scoreboard 1605 shown in FIGS. 16 and 17, the scoreboard 1805 shown in FIGS. 18 and 20, the scoreboard 1905 shown in FIG. 19, and/or the scoreboard 2705 shown in FIG. 27.

In the illustrated example, the scoreboard 2705 further includes one or more hangers 2905. The hanger 2905 allows the scoreboard 2705 to be attached and/or hung from a fence or other structure near the field of play 105. In one example, the hangers 2905 are foldable and/or retractable from the housing 705. In another example, the hangers 2905 help support the scoreboard 2705 in an upright position when extended from the housing 705 and when the scoreboard 2705 is placed on a ground surface.

Figure 30:
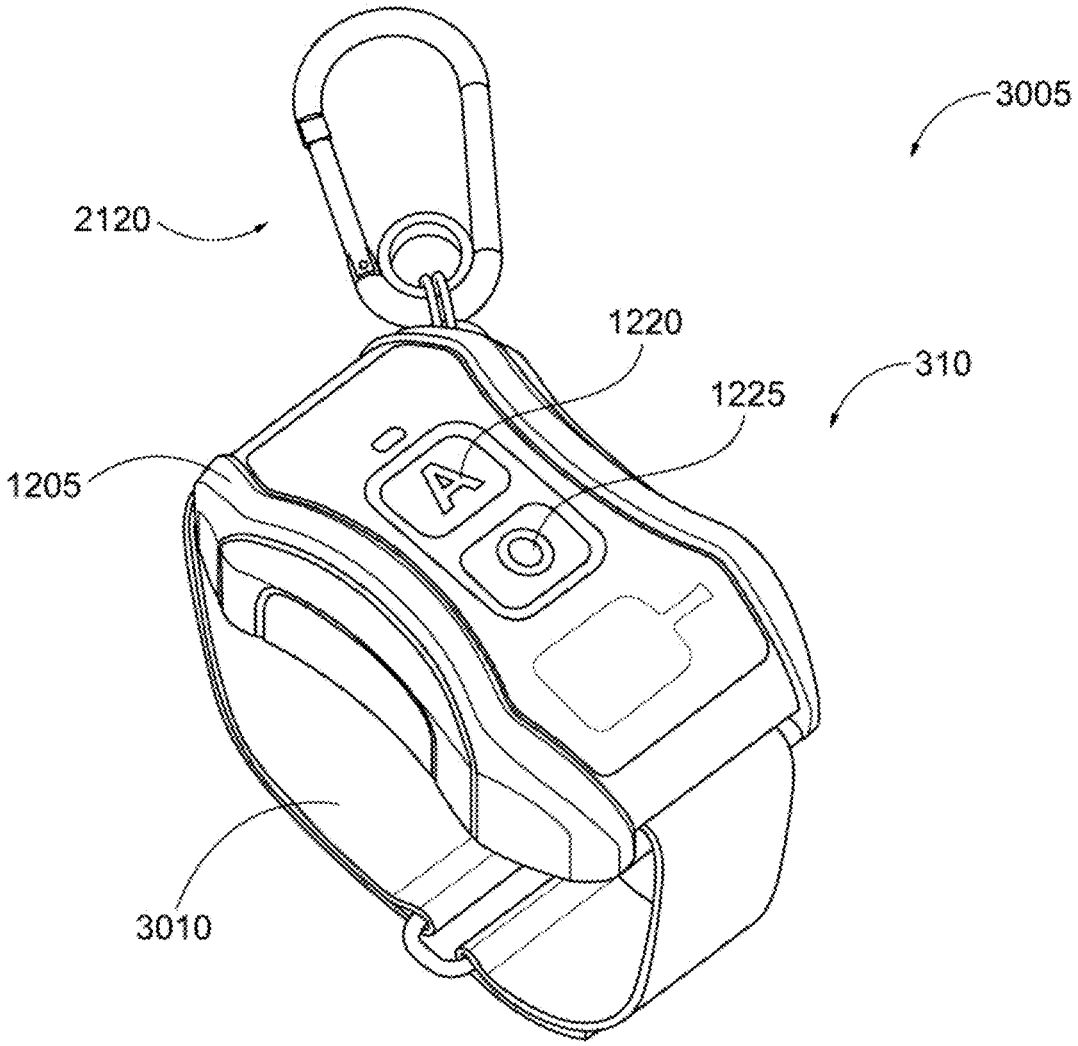
FIG. 30 is a front perspective view of the FIG. 3 fob according to another example.

FIG. 30 illustrates a fob 3005, an additional example of the fob 115. The fob 3005 generally includes the same components as the fob 115 shown in previous figures, such as the input device 310, the housing 1205, the first button 1220, the second button 1225, and the fob loop 2120 among other examples. In some examples, the fob 3005 includes one or more parts not in the fob 115, omits one or more parts from the fob 115, and/or includes a part in a different form than in the fob 115. As shown, the fob 3005 includes a strap 3010. The strap 3010 is configured to attach the fob 3005 to the wrist and/or another part of a player. In the FIG. 30 example, the fob loop 2120 is in the form of a carabiner. The strap 3010 and/or the fob loop 2120 generally allow the fob 3005 to be kept on the player during the course of the game. Further, the fob 3005 is generally configured to utilize any arrangement of input devices 310. As should be appreciated, the fob 115 shown in FIG. 1 is configured to incorporate any combination of features from the fob 115 shown in FIG. 12, the fob 2105 shown in FIG. 21, the fob 2205 shown in FIG. 22, and/or the fob 3005 shown in FIG. 30.

GLOSSARY OF TERMS

The language used in the claims and specification is to only have its plain and ordinary meaning, except as explicitly defined below. The words in these definitions are to only have their plain and ordinary meaning. Such plain and ordinary meaning is inclusive of all consistent dictionary definitions from the most recently published Webster's dictionaries and Random House dictionaries. As used in the specification and claims, the following definitions apply to these terms and common variations thereof identified below.

"And/Or" generally refers to a grammatical conjunction indicating that one or more of the cases it connects may occur. For instance, it can indicate that either or both of the two stated cases can occur. In general, "and/or" includes any combination of the listed collection. For example, "X, Y, and/or Z" encompasses: any one letter individually (e.g., {X}, {Y}, {Z}); any combination of two of the letters (e.g., {X, Y}, {X, Z}, {Y, Z}); and all three letters (e.g., {X, Y, Z}). Such combinations may include other unlisted elements as well.

"Antenna" or "Antenna system" generally refers to an electrical device, or series of devices, in any suitable configuration, that converts electric power into electromagnetic radiation. Such radiation may be either vertically, horizontally, or circularly polarized at any frequency along the electromagnetic spectrum. Antennas transmitting with circular polarity may have either right-handed or left-handed polarization. In the case of radio waves, an antenna may transmit at frequencies ranging along an electromagnetic spectrum from extremely low frequency (ELF) to extremely high frequency (EHF). An antenna or antenna system designed to transmit radio waves may comprise an arrangement of metallic conductors (elements), electrically connected (often through a transmission line) to a receiver or transmitter. An oscillating current of electrons forced through the antenna by a transmitter can create an oscillating magnetic field around the antenna elements, while the charge of the electrons also creates an oscillating electric field along the elements. These time-varying fields radiate away from the antenna into space as a moving transverse electromagnetic field wave. Conversely, during reception, the oscillating electric and magnetic fields of an incoming electromagnetic wave exert force on the electrons in the antenna elements, causing them to move back and forth, creating oscillating currents in the antenna. These currents can then be detected by receivers and processed to retrieve digital or analog signals or data. Antennas can be designed to transmit and receive radio waves substantially equally in all horizontal directions (omnidirectional antennas), or preferentially in a particular direction (directional or high gain antennas). In the latter case, an antenna may also include additional elements or surfaces which may or may not have any physical electrical connection to the transmitter or receiver. For example, parasitic elements, parabolic reflectors or horns, and other such non-energized elements serve to direct the radio waves into a beam or other desired radiation pattern. Thus antennas may be configured to exhibit increased or decreased directionality or "gain" by the placement of these various surfaces or elements. High gain antennas can be configured to direct a substantially large portion of the radiated electromagnetic energy in a given direction that may be vertical, horizontal, or any combination thereof. Antennas may also be configured to radiate electromagnetic energy within a specific range of vertical angles (i.e. takeoff angles) relative to the earth in order to focus electromagnetic energy toward an upper layer of the atmosphere such as the ionosphere. By directing electromagnetic energy toward the upper atmosphere at a specific angle, specific skip distances may be achieved at particular times of day by transmitting electromagnetic energy at particular frequencies. Other examples of antennas include emitters and sensors that convert electrical energy into pulses of electromagnetic energy in the visible or invisible light portion of the electromagnetic spectrum. Examples include light emitting diodes, lasers, and the like that are configured to generate electromagnetic energy at frequencies ranging along the electromagnetic spectrum from far infrared to extreme ultraviolet.

"Battery" generally refers to a device that converts chemical energy into electrical energy. The battery stores energy in chemical form and then discharges the energy by converting chemical energy into electricity. The battery generally includes one or more electrochemical cells and terminals. The terminals usually include an anode and a cathode.

"Circuit Board" or "Board" generally refers to a piece of hardware that contains an electrical circuit assembly. The circuit assembly may include one or more electrical or electromechanical circuit components including capacitors, inductors, semiconductors, switches, resistors, and programmable devices. The board may contain any number of terminals that enable electrical connections to external electrical circuits or components. Electrical inputs to one or more terminals on the board may be altered and output to one or more different terminals. Electrical inputs may also be routed between any number of terminals without being altered.

"Communication Link" or "Communication Channel" generally refers to a connection between two or more communicating entities and may or may not include a communications channel between the communicating entities. The communication between the communicating entities may occur by any suitable means. For example, the connection may be implemented as an actual physical link, an electrical link, an electromagnetic link, a logical link, or any other suitable linkage facilitating communication. In the case of an actual physical link, communication may occur by multiple components in the communication link configured to respond to one another by physical movement of one element in relation to another. In the case of an electrical link, the communication link may be composed of multiple electrical conductors electrically connected to form the communication link. In the case of an electromagnetic link, elements of the connection may be implemented by sending or receiving electromagnetic energy at any suitable frequency, thus allowing communications to pass as electromagnetic waves. These electromagnetic waves may or may not pass through a physical medium such as an optical fiber, or through free space, or any combination thereof. Electromagnetic waves may be passed at any suitable frequency including any frequency in the electromagnetic spectrum. In the case of a logical link, the communication links may be a conceptual linkage between the sender and recipient such as a transmission station in the receiving station. Logical link may include any combination of physical, electrical, electromagnetic, or other types of communication links.

"Computer" generally refers to any computing device configured to compute a result from any number of input values or variables. A computer may include a processor for performing calculations to process input or output. A computer may include a memory for storing values to be processed by the processor, or for storing the results of previous processing. A computer may also be configured to accept input and output from a wide array of input and output devices for receiving or sending values. Such devices include other computers, keyboards, mice, visual displays, printers, industrial equipment, and systems or machinery of all types and sizes. For example, a computer can control a network interface to perform various network communications upon request. A computer may be a single, physical, computing device such as a desktop computer, a laptop computer, or may be composed of multiple devices of the same type such as a group of servers operating as one device in a networked cluster, or a heterogeneous combination of different computing devices operating as one computer and linked together by a communication network. A computer may include one or more physical processors or other computing devices or circuitry and may also include any suitable type of memory. A computer may also be a virtual computing platform having an unknown or fluctuating number of physical processors and memories or memory devices. A computer may thus be physically located in one geographical location or physically spread across several widely scattered locations with multiple processors linked together by a communication network to operate as a single computer. The concept of "computer" and "processor" within a computer or computing device also encompasses any such processor or computing device serving to make calculations or comparisons as part of a disclosed system. Processing operations related to threshold comparisons, rules comparisons, calculations, and the like occurring in a computer may occur, for example, on separate servers, the same server with separate processors, or on a virtual computing environment having an unknown number of physical processors as described above.

"Controller" generally refers to a device, using mechanical, hydraulic, pneumatic electronic techniques, and/or a microprocessor or computer, which monitors and physically alters the operating conditions of a given dynamical system. In one non-limiting example, the controller can include an Allen Bradley brand Programmable Logic Controller (PLC). A controller may include a processor for performing calculations to process input or output. A controller may include a memory for storing values to be processed by the processor, or for storing the results of previous processing. A controller may also be configured to accept input and output from a wide array of input and output devices for receiving or sending values. Such devices include other computers, keyboards, mice, visual displays, printers, industrial equipment, and systems or machinery of all types and sizes. For example, a controller can control a network or network interface to perform various network communications upon request. The network interface may be part of the controller or characterized as separate and remote from the controller. A controller may be a single, physical, computing device such as a desktop computer, or a laptop computer, or may be composed of multiple devices of the same type such as a group of servers operating as one device in a networked cluster, or a heterogeneous combination of different computing devices operating as one controller and linked together by a communication network. The communication network connected to the controller may also be connected to a wider network such as the Internet. Thus, a controller may include one or more physical processors or other computing devices or circuitry and may also include any suitable type of memory. A controller may also be a virtual computing platform having an unknown or fluctuating number of physical processors and memories or memory devices. A controller may thus be physically located in one geographical location or physically spread across several widely scattered locations with multiple processors linked together by a communication network to operate as a single controller. Multiple controllers or computing devices may be configured to communicate with one another or with other devices over wired or wireless communication links to form a network. Network communications may pass through various controllers operating as network appliances such as switches, routers, firewalls or other network devices or interfaces before passing over other larger computer networks such as the Internet. Communications can also be passed over the network as wireless data transmissions carried over electromagnetic waves through transmission lines or free space. Such communications include using Wi-Fi or other Wireless Local Area Network (WLAN) or a cellular transmitter/receiver to transfer data.

"Display" or "Display Device" generally refers to any device capable of being controlled by an electronic circuit or processor to display information in a visual or tactile manner. A display device may be configured as an input device taking input from a user or other system (e.g., a touch sensitive computer screen), or as an output device generating visual or tactile information, or the display device may be configured to operate as both an input or output device at the same time, or at different times. The output may be two-dimensional, three-dimensional, and/or mechanical displays and includes, but is not limited to, the following display technologies: Cathode Ray Tube display (CRT), Light-Emitting Diode display (LED), Electroluminescent Display (ELD), electronic paper, Electrophoretic Ink (E-ink), Plasma Display Panel (PDP), Liquid Crystal Display (LCD), High-Performance Addressing display (HPA), Thin-film Transistor display (TFT), Organic Light-Emitting Diode display (OLED), Surface-conduction Electron-emitter Display (SED), laser TV, carbon nanotubes, quantum dot display, Interferometric Modulator Display (IMOD), Swept-volume display, Varifocal mirror display, Emissive volume display, Laser display, Holographic display, Light field displays, Volumetric display, Ticker tape, Split-flap display, Flip-disc display (or flip-dot display), Rollsign, mechanical gauges with moving needles and accompanying indicia, Tactile electronic displays (aka refreshable Braille display), Optacon displays, or any devices that either alone or in combination are configured to provide visual feedback on the status of a system, such as the "check engine" light, a "low altitude" warning light, and/or an array of red, yellow, and green indicators configured to indicate a temperature range.

"Electromagnetic Waves" generally refers to waves having a separate electrical and a magnetic component. The electrical and magnetic components of an electromagnetic wave oscillate in phase and are always separated by a 90-degree angle. Electromagnetic waves can radiate from a source to create electromagnetic radiation capable of passing through a medium or through a vacuum. Electromagnetic waves include waves oscillating at any frequency in the electromagnetic spectrum including, but not limited to, radio waves, visible and invisible light, X-rays, and gamma-rays.

"Energy Storage System" (ESS) or "Energy Storage Unit" generally refers to a device that captures energy produced at one time for use at a later time. The energy can be supplied to the ESS in one or more forms, for example including radiation, chemical, gravitational potential, electrical potential, electricity, elevated temperature, latent heat, and kinetic types of energy. The ESS converts the energy from forms that are difficult to store to more conveniently and/or economically storable forms. By way of non-limiting examples, techniques for accumulating the energy in the ESS can include: mechanical capturing techniques, such as compressed air storage, flywheels, gravitational potential energy devices, springs, and hydraulic accumulators; electrical and/or electromagnetic capturing techniques, such as using capacitors, super capacitors, and superconducting magnetic energy storage coils; biological techniques, such as using glycogen, biofuel, and starch storage mediums; electrochemical capturing techniques, such as using flow batteries, rechargeable batteries, and ultra-batteries; thermal capture techniques, such as using eutectic systems, molten salt storage, phase-change materials, and steam accumulators; and/or chemical capture techniques, such as using hydrated salts, hydrogen, and hydrogen peroxide. Common ESS examples include lithium-ion batteries and super capacitors.

"Fob" generally refers to a small item that is attached to something else, often for practical or decorative purposes. For example, a fob can be attached to a keychain or lanyard, used for convenience, identification, or security purposes. Common types include decorative key fobs, which serve as ornamental attachments to keys, and electronic fobs, which contain RFID chips or other wireless technology to enable remote access to vehicles, buildings, or secure systems. These devices are often compact and portable, designed to be easily carried in a pocket or bag, and are widely used in both personal and professional settings for quick and secure authentication or access control.

"Handheld" generally refers to an object, such as a tool or other device, which has been designed so that object can be easily held, used, and operated with one or two hands of a human being. In other words, a handheld device is designed to be small and light enough to be operated in the hand of a human being for an extended period of time without experiencing significant fatigue.

"Housing" generally refers to a component that covers, protects, or supports another thing. For example, the casing of a desktop computer is its housing component and can be made of multiple materials to protect the internal component.

"Identifier" generally refers to a mark, symbol, tag, name, image, and/or signal that identifies (that is, labels the identity of) either a unique thing or a unique class of things, where the "object" or class may be an idea, physical object (or class thereof), or physical substance (or class thereof). The abbreviation "ID" often refers to identity, identification (the process of identifying), or an identifier (that is, an instance of identification). An identifier may or may not include words, numbers, letters, symbols, shapes, colors, sounds, or any combination of those. The words, numbers, letters, or symbols may follow an encoding system (wherein letters, digits, words, or symbols represent ideas or longer identifiers) or they may simply be arbitrary. When an identifier follows an encoding system, it is often referred to as a code or ID code. Identifiers that do not follow any encoding scheme are often said to be arbitrary IDs because they are arbitrarily assigned without meaning in any other context beyond identifying something.

"Input Device" generally refers to any device coupled to a computer that is configured to receive input and deliver the input to a processor, memory, or other part of the computer. Such input devices can include keyboards, mice, trackballs, and touch sensitive pointing devices such as touchpads or touchscreens. Input devices also include any sensor or sensor array for detecting environmental conditions such as temperature, light, noise, vibration, humidity, and the like.

"Integrated Circuit (IC)" or "Microchip" generally refers to one or more electronic circuits integrated into a relatively small board and/or piece of semiconductor material. The IC typically incorporates many electronic components, such as transistors, diodes, resistors, and/or capacitors, into a packaging that is on a similar scale to some discrete electronic components. ICs can be designed for a variety of purposes, such as performing logical operations, storing data, and/or processing signals as some examples. The complexity of ICs can vary greatly. On the simple end, ICs are generally configured to perform a single task and/or have a relatively small number of components, such as below 100,000 or below 1 million transistors. Some examples of simple ICs include logic gates, operational amplifiers, comparators, timers, clocks, switches, multiplexers, encoders, simple memory chips, counters, shift registers, voltage regulators, Analog-to-Digital Converters (ADCs), and Digital-to-Analog Converters (DACs) to name a few. On the complex end, ICs are generally capable of performing a wide range of tasks, are programmable, and/or contain a large number of components, such as millions or even billions of transistors. Some examples of complex ICs include Central Processing Units (CPUs), Graphics Processing Units (GPUs), Systems on Chips (SoCs), Field-Programmable Gate Arrays (FP- GAs), and/or other types of processors. In some examples, complex ICs include multiple simple ICs.

"Light Emitting Diode" or "LED" generally refers to a semiconductor diode, made from certain materials, in which light is emitted in response to application of an electrical current. A variety of materials in the LED can produce a range of colors. The color of the light (corresponding to the energy of the photons) is determined by the energy required for electrons to cross the band gap of the semiconductor. Typically, but not always, white light is obtained by using multiple semiconductors or a layer of light-emitting phosphor on the semiconductor device. The LED can come in the form of a variety of colors, shapes, sizes and designs, including with or without heat sinking, lenses, or reflectors, built into the package.

"Light Emitting Element" generally refers to a component that converts electrical energy into visible light energy, infrared light energy and/or ultraviolet such as by LEDs, incandescent lamps, graphene, silicene, or otherwise. Light emitting elements emitting infrared light energy may have use, for example, in military vehicle applications.

"Memory" generally refers to any storage system or device configured to retain data or information. Each memory may include one or more types of solid-state electronic memory, magnetic memory, or optical memory, just to name a few. By way of non-limiting example, each memory may include solid-state electronic Random Access Memory (RAM), Sequentially Accessible Memory (SAM) (such as the First-In, First-Out (FIFO) variety or the Last-In-First-Out (LIFO) variety), Programmable Read Only Memory (PROM), Electronically Programmable Read Only Memory (EPROM), or Electrically Erasable Programmable Read Only Memory (EEPROM); an optical disc memory (such as a DVD or CD ROM); a magnetically encoded hard disc, floppy disc, tape, or cartridge media; or a combination of any of these memory types. Also, each memory may be volatile, nonvolatile, or a hybrid combination of volatile and nonvolatile varieties.

"Mobile Device" generally refers to a piece of portable electronic equipment that can connect to a network such as a wireless network, a mobile network, and/or the internet. For instance, a mobile device can include a smartphone or tablet computer.

"Mounted" generally refers to an object being physically attached to and/or held in place with respect to another object like a support, frame, and/or chassis.

"Network" or "Computer Network" generally refers to a telecommunications network that allows computers to exchange data. Computers can pass data to each other along data connections by transforming data into a collection of datagrams or packets. The connections between computers and the network may be established using either cables, optical fibers, or via electromagnetic transmissions such as for wireless network devices. Computers coupled to a network may be referred to as "nodes" or as "hosts" and may originate, broadcast, route, or accept data from the network. Nodes can include any computing device such as personal computers, phones, and servers as well as specialized computers that operate to maintain the flow of data across the network, referred to as "network devices". Two nodes can be considered "networked together" when one device is able to exchange information with another device, whether or not they have a direct connection to each other. Examples of wired network connections may include Digital Subscriber Lines (DSL), coaxial cable lines, or optical fiber lines. The wireless connections may include BLUETOOTH®, Worldwide Interoperability for Microwave Access (WiMAX), infrared channel or satellite band, or any wireless local area network (Wi-Fi) such as those implemented using the Institute of Electrical and Electronics Engineers' (IEEE) 802.11 standards (e.g. 802.11(a), 802.11(b), 802.11(g), or 802.11(n) to name a few). Wireless links may also include or use any cellular network standards used to communicate among mobile devices including 1G, 2G, 3G, 4G, or 5G. The network standards may qualify as 1G, 2G, etc. by fulfilling a specification or standards such as the specifications maintained by the International Telecommunication Union (ITU). For example, a network may be referred to as a "3G network" if it meets the criteria in the International Mobile Telecommunications-2000 (IMT-2000) specification regardless of what it may otherwise be referred to. A network may be referred to as a "4G network" if it meets the requirements of the International Mobile Telecommunications Advanced (IMTAdvanced) specification. Examples of cellular network or other wireless standards include AMPS, GSM, GPRS, UMTS, LTE, LTE Advanced, Mobile WiMAX, and WiMAX-Advanced. Cellular network standards may use various channel access methods such as FDMA, TDMA, CDMA, or SDMA. Different types of data may be transmitted via different links and standards, or the same types of data may be transmitted via different links and standards. The geographical scope of the network may vary widely. Examples include a Body Area Network (BAN), a Personal Area Network (PAN), a Local-Area Network (LAN), a Metropolitan Area Network (MAN), a Wide Area Network (WAN), or the Internet. A network may have any suitable network topology defining the number and use of the network connections. The network topology may be of any suitable form and may include point-to-point, bus, star, ring, mesh, or tree. A network may be an overlay network which is virtual and is configured as one or more layers that use or "lay on top of" other networks.

"Operatively Coupled" generally refers to a connection where at least two devices and/or structures are directly or indirectly connected to communicate with one another, be secured together, and/or function together. For instance, the devices can be connected through a wired and/or wireless connection in order to exchange data, commands, and/or other types of information. The devices can be directly connected together or indirectly connected together through a third-party device. In one case, electrical current can flow between the devices through electrically conductive wire, and in other cases, other types of electromagnetic radiation, such as visible light and radio waves, can be exchanged through various media, such via fiber optic cable. When operatively coupled, the devices and/or structures can be physically connected to one another via a direct connection or an indirect connection, such as via fasteners, adhesives, and/or mechanical linkages, to name just a few examples.

"Pickleball" generally refers to a paddle sport in which players hit a ball over a net from opposing sides on a court. The ball is typically a perforated hollow plastic ball, such as a wiffleball or other similar ball. The paddle typically has a solid and smooth face, like a table tennis, paddleball, or other type of paddle. In official rules, the net on a pickleball court is 34 inches high. Pickleball is commonly played by two players (i.e., singles) or by four players (i.e., doubles). In some cases, pickleball can be played by 3 players or using other player arrangements. To start the game, a player on the serving team serves a ball to the receiving ball. Typically, the serve must follow several rules that specify the position and movement of the paddle while hitting the ball, the position of the server while hitting the ball, and the landing point of the ball. Each player has one attempt to serve. In doubles, the other player on the serving team has an opportunity to serve if the first player committed a fault (i.e. a rules violation). Players can switch between left and right sides of the court when serving after a point is scored. Generally, a point is scored by one team when the other team commits a fault. A fault is any violation of the rules, including a serve landing outside the boundary of the court, a ball hitting into the net, a player touching the net, a ball hitting the player during play, a ball being hit out of bounds, a ball bouncing twice before being struck, and a serve violation as some examples. Under traditional rules, only the serving team can score and the serve passes to the other team after a fault by the serving team. In other rule sets, either team can score and a point is scored at the end of every rally.

"Power Converter" generally refers to a device that changes one form of energy to another form. In electrical systems, power converters change electric energy from one form to another, such as converting alternating current (AC) to direct current (DC) (or vice-versa) and/or changing electrical voltage, current, frequency, and/or phase of the electricity. For DC-to-DC conversion, the power converter can include voltage regulators and/or linear regulators. The power converter can include an inverter to change DC to AC, and the power converter can include a rectifier to change AC to DC. For AC-to-AC conversion, the power converter can include a transformer, autotransformer, variable-frequency transformer, voltage converter, voltage regulator, and/or cycloconverter. These of course are just a few non-limiting examples. Power converters can also change other forms of energy, such as mechanical and/or chemical energy, to name just a few. For instance, the power converter can include a hydraulic pump that converts electrical energy to mechanical energy when the energy storage system is in the form of a hydraulic accumulator.

"Processor" generally refers to one or more electronic components configured to operate as a single unit configured or programmed to process input to generate an output. Alternatively, when of a multi-component form, a processor may have one or more components located remotely relative to the others. One or more components of each processor may be of the electronic variety defining digital circuitry, analog circuitry, or both. In one example, each processor is of a conventional, integrated circuit microprocessor arrangement. The concept of a "processor" is not limited to a single physical logic circuit or package of circuits but includes one or more such circuits or circuit packages possibly contained within or across multiple computers in numerous physical locations. In a virtual computing environment, an unknown number of physical processors may be actively processing data, and the unknown number may automatically change over time as well. The concept of a "processor" includes a device configured or programmed to make threshold comparisons, rules comparisons, calculations, or perform logical operations applying a rule to data yielding a logical result (e.g., "true" or "false"). Processing activities may occur in multiple single processors on separate servers, on multiple processors in a single server with separate processors, or on multiple processors physically remote from one another in separate computing devices.

"Paddle Sport" or "Racket Sport" generally refers to a game in which one or more players hit a ball or other object with a paddle, racket, or other type of equipment. As some examples, the paddle or racket can include a striking surface formed by a solid face, a perforated face, and/or strings stretched across a frame. Some examples of racket sports include badminton, tennis, racquetball, squash, paddle ball, pickleball, and table tennis. Racket sports can be played on open courts, on raised tables, or in an enclosed space as some examples. Players can hit the ball to another player, against a wall, or against another surface as examples. Typically, one player starts a game or rally by serving the ball. Depending on the game, players can score points when the other team fails to return a ball, hits a ball out of bounds, hits a ball into a net, allows the ball to bounce multiple times, violates a serving rule, and/or commits another type of fault. In some games, the serving team, the serving player, the score, and/or other details change after each break in play. Oftentimes, players or an officiator are expected to announce the score before resuming the game with a serve. Further, racket sports can be played across one or more matches, sets, and/or games.

"Radio" generally refers to electromagnetic radiation in the frequencies that occupy the range from 3 kHz to 300 GHz.

"Receiver" generally refers to a device that captures and processes signals or data sent from a transmitter, often as part of a communication system. Common receiver types can include radio receivers and infrared receivers.

"Remote" generally refers to any physical, logical, or other separation between two things. The separation may be relatively large, such as thousands or millions of miles or kilometers, or small such as nanometers or millionths of an inch. Two things "remote" from one another may also be logically or physically coupled or connected together.

"Remote Control" generally refers to a device configured to operate another apparatus, machine, system, and/or electronic device from a distance without physical contact. Usually, but not always, the remote control is a handheld device that transmits one or more signals wirelessly, such as via infrared light or radio waves, to a receiver on a target device. Commonly, the remote control includes tactile input devices, such as physical buttons, that allow a user to provide inputs. In many examples, the remote control utilizes relatively simple circuitry rather than a processor or other more complex computing circuits. In some examples, the remote control includes discrete analog circuit components, diodes, and/or transistors to convert signals from the tactile inputs into wireless control signals. In other examples, the remote control includes one or more integrated circuits adapted for a particular use, such as timers, clocks, counters, modulators, demodulators, amplifiers, filters, and/or frequency synthesizers as some examples.

"Short-Range Communication" generally refers to any network that is capable of transmitting data over short distances using high-frequency electromagnetic radiation. Some examples of short-range communication protocols include, but are not limited to Bluetooth®, Wi-Fi, RFID, ZigBee®, and Thread® protocol standards.

"Signal" generally refers to a function or means of representing information. It may be thought of as the output of a transformation or encoding process. The concept generally includes a change in the state of a medium or carrier that conveys the information. The medium can be any suitable medium such as air, water, electricity, magnetism, or electromagnetic energy such as in the case of radio waves, pulses of visible or invisible light, and the like. As used herein, a "signal" implies a representation of meaningful information. Arbitrary or random changes in the state of a carrier medium are generally not considered "signals" and may be considered "noise". For example, arbitrary binary data streams are not considered as signals. On the other hand, analog and digital signals that are representations of analog physical quantities are examples of signals. A signal is commonly not useful without some way to transmit or send the information, and a receiver responsive to the transmitter for receiving the information. In a communication system, for example, a transmitter encodes a message to a signal, which is carried to a receiver by the communications channel. For example, the words "The time is 12 o'clock" might be the message spoken into a telephone. The telephone transmitter may then convert the sounds into an electrical voltage signal. The signal is transmitted to the receiving telephone by wires, at the receiver it is reconverted into sounds. Signals may be thought of as "discrete" or "continuous." Discrete-time signals are often referred to as time series in other fields. Continuous-time signals are often referred to as continuous signals even when the signal functions are not continuous, such as in a square-wave signal. Another categorization is signals which are "discrete-valued" and "continuous-valued". Particularly in digital signal processing a digital signal is sometimes defined as a sequence of discrete values, that may or may not be derived from an underlying continuous-valued physical process. In other contexts, digital signals are defined as the continuous-time waveform signals in a digital system, representing a bit-stream. In the first case, a signal that is generated by means of a digital modulation method may be considered as converted to an analog signal, while it may be considered as a digital signal in the second case.

"Socket" or "Jack" generally refers to a receptacle, slot, and/or opening that electrically connects to a plug when the plug is inserted. In other words, a socket is typically a female connector that interfaces with a male connector to make an electrical connection. Many devices, such as computers, telephones, display devices, networking devices, audio devices, and/or other types of devices, include sockets to support electrical connections between each other. Sometimes sockets are attached to a wall and/or another structure to support electrical connections to a network, audio/visual system, and/or power source as examples. Sockets generally include one or more electrical contacts, such as electrically conductive pads, pins, leaves, and/or plates as examples. In some cases, the contacts in a socket extend outward and insert into the plug as the plug inserts into the socket. Sockets often, but not always, come in a standardized shape, such as USB-A, USB-B, USB-C, HDMI, VGA, 3.5 mm audio, Ethernet, landline telephone, and/or various standardized power plugs to name a few. Similarly, the contacts in a socket are generally arranged according to a standardized pinout. For example, many computers, modems, routers, network switches, and/or other network devices include a Registered Jack (RJ) 45 jack to support connections via Ethernet. As another example, many telephones and/or telephone network devices include an RJ11, RJ14, and/or RJ25 jack to connect over a telephone line. Further, the socket typically mechanically connects to the plug when the plug is inserted, such as through a clip, tab, and/or another mechanism. In some cases, the socket defines a notch and/or recess that receives a latch tab on the plug. Some sockets utilize such a notch and/or include other keying mechanisms to ensure a plug can only be inserted in one orientation.

"Transceiver" generally refers to a device that includes both a transmitter and a receiver that share common circuitry and/or a single housing. Transceivers are typically, but not always, designed to transmit and receive electronic signals, such as analog and/or digital radio signals.

"Transmitter" generally refers to a device that sends signals or data from one location to another, often as part of a communication system. Common transmitter types can include radio transmitters and infrared transmitters.

"USB port" generally refers to a physical interface on an electronic or electric system that allows for the connection of a power source and data transfer. Common USB port types can include USB-A, USB-B, USB-C, and micro-USB connectors.

It should be noted that the singular forms "a," "an," "the," and the like as used in the description and/or the claims include the plural forms unless expressly discussed otherwise. For example, if the specification and/or claims refer to "a device" or "the device", it includes one or more of such devices.

It should be noted that directional terms, such as "up," "down," "top," "bottom," "lateral," "longitudinal," "radial," "circumferential," "horizontal," "vertical," etc., are used herein solely for the convenience of the reader in order to aid in the reader's understanding of the illustrated embodiments, and it is not the intent that the use of these directional terms in any manner limit the described, illustrated, and/or claimed features to a specific direction and/or orientation.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by the following claims are desired to be protected. All publications, patents, and patent applications cited in this specification are herein incorporated by reference as if each individual publication, patent, or patent application were specifically and individually indicated to be incorporated by reference and set forth in its entirety herein.

REFERENCE NUMBERS

100 system
105 field of play
110 scoreboard
112 remote control
115 fob
120 user
125 serving team
130 receiving team
135 first server
140 second server
205 controller
210 display
215 transceiver
220 input device
225 speaker
230 ESS
235 processor
240 memory
305 controller
310 input device
315 transceiver
320 ESS
325 integrated circuit
405 external display device
410 display output module
415 television
420 tablet
425 screen
505 data management system
510 network
605 processor
610 memory
615 storage device

620 networking device
625 input device
630 display
705 housing
710 first team score display
715 second team score display
720 server number display
725 serving team display
730 activity indicator
735 first button
740 second button
745 reset button
750 undo button
755 mode button
760 sound button
765 power button
905 power indicator
910 sound indicator
1005 port
1105 mounting hole
1205 housing
1210 clip
1215 antenna
1220 first button
1225 second button
1305 display driver
1310 7-segment display
1405 circuit board
1410 first board
1415 second board
1605 scoreboard
1705 end match button
1710 custom button
1715 antenna
1805 scoreboard
1905 scoreboard
2105 fob
2110 power button
2115 undo button
2120 fob loop
2205 fob
2305 USB interface
2405 charge control circuit
2505 power converter
2510 first voltage converter
2515 second voltage converter
2520 third voltage converter
2705 scoreboard
2905 hanger
3005 fob
3010 strap

What is claimed is:

1. A system, comprising:

a scoreboard configured to track scoring of a pickleball game;

wherein the scoreboard includes a controller;

wherein the scoreboard includes a display;

wherein the display is operatively coupled to the controller;

wherein the display is configured to display the scoring;

wherein the scoreboard includes a transceiver;

wherein the transceiver is operatively coupled to the controller;

a first fob including a first input device, a first fob controller operatively coupled to the first input device, and a first fob transceiver operatively coupled to the first fob controller;

wherein the first fob controller is configured to store a first identifier;

wherein the first identifier identifies a first player and/or team;

wherein the first fob controller is configured to transmit a first wireless signal including a first input and the first identifier to the transceiver of the scoreboard when the first input device receives the first input;

wherein the controller of the scoreboard is configured to determine a first change to scoring in response to receiving the first wireless signal;

wherein the controller of the scoreboard is configured to update the display in response to the first change to the scoring;

a second fob including a second input device, a second fob controller operatively coupled to the second input device, and a second fob transceiver operatively coupled to the second fob controller;

wherein the second fob controller is configured to store a second identifier;

wherein the second identifier identifies a second player and/or team;

wherein the second fob controller is configured to transmit a second wireless signal including a second input and the second identifier to the transceiver of the scoreboard when the second input device receives the second input;

wherein the controller of the scoreboard is configured to determine a second changes to the scoring in response to receiving the second wireless signal;

wherein the controller of the scoreboard is configured to update the display in response to the second change to the scoring;

wherein the second fob is configured to transmit an undo wireless signal to the transceiver of the scoreboard to undo the second change to the scoring; and wherein the controller is configured to undo the second change to the scoring on the display in response to receiving the undo wireless signal from the second fob.

2. The system of claim 1, wherein:

the display is configured to display which player is serving;

the scoreboard is configured to increase a score of a serving team when receiving the first input;

the scoreboard is configured to change a server when receiving the second input;

the scoreboard includes a speaker;

the speaker is operatively coupled to the controller; and the scoreboard is configured to audibly announce via the speaker the scoring before a player serves.

3. The system of claim 2, wherein the remote control includes a fob;

the first fob includes an input device;

the input device includes a first button;

the first fob is configured to send the first input to the scoreboard when the first button is pressed; and the input device includes a second button.

4. The system of claim 2, wherein the scoreboard is configured to communicate with a mobile device; and the scoreboard is configured to adjust one or more settings on the scoreboard based on communication with the mobile device.

5. The system of claim 3, wherein the scoreboard is configured to visually distinguish information related to each team on the display based on the identifier associated with that team.

6. The system of claim 5, wherein the scoreboard is configured to display the scoring for each team using a color associated with that team; and the scoreboard is configured to display which player is serving using a color associated with the team of that player.

7. The system of claim 2, wherein the scoreboard is configured to connect to up to four fobs;

the scoreboard is configured to register inputs from fob at a time; and the scoreboard is configured to register inputs from the fob that is controlled by a player currently up to serve.

8. The system of claim 1, further comprising:

a data management system (DMS) including a computer;

wherein the DMS is wirelessly connected to the scoreboard;

wherein the DMS is configured to communicate with multiple scoreboards;

wherein the scoreboard is configured to send scores and a game result to the DMS; and wherein the DMS is configured to process information recorded from multiple games.

9. The system of claim 1, wherein:

the scoreboard is configured to connect to an external display; and the scoreboard is configured to connect to the external display over a wireless connection.

10. The system of claim 1, wherein:

the scoreboard is configured to receive a game mode input;

the scoreboard is configured to adjust a game mode in response to the game mode input; and the scoreboard is configured to update a score and/or a player that is serving based partly on the game mode.

11. The system of claim 1, wherein the controller is configured to undo the second change to the scoring on the display in response to receiving the undo wireless signal from the second fob.

12. The system of claim 11, wherein the controller of the scoreboard is solely capable of determining the changes to the scoring.

* * * * *